US007451972B2

(12) United States Patent
Fukada et al.

(10) Patent No.: US 7,451,972 B2
(45) Date of Patent: Nov. 18, 2008

(54) HYBRID PAPER SUPPLY MODULE AND IMAGE FORMING APPARATUS EQUIPPED WITH SUCH HYBRID PAPER SUPPLY MODULE, AND ALSO PAPER SUPPLY MECHANISM AND IMAGE FORMING APPARATUS EQUIPPED WITH SUCH PAPER SUPPLY MECHANISM

(75) Inventors: Yasuaki Fukada, Nara (JP); Susumu Hashimoto, Nara (JP); Shigeru Yoshida, Nara (JP); Takashi Kubo, Kyoto (JP); Yoshiaki Hiramoto, Nara (JP); Yasushi Matsutomo, Nara (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 186 days.

(21) Appl. No.: 10/949,389

(22) Filed: Sep. 27, 2004

(65) Prior Publication Data

US 2005/0073085 A1 Apr. 7, 2005

(30) Foreign Application Priority Data

Oct. 2, 2003 (JP) ..... 2003-344584
Oct. 2, 2003 (JP) ..... 2003-344585

(51) Int. Cl.
*B65H 3/44* (2006.01)

(52) U.S. Cl. ..... 271/9.09; 271/9.01; 271/9.12; 271/9.13; 399/392; 399/124

(58) Field of Classification Search ..... 271/9.01, 271/9.09, 9.11, 9.13, 9.12, 273, 274; 399/391, 399/392, 124

See application file for complete search history.

(56) References Cited

U.S. PATENT DOCUMENTS 5,418,606 A * 5/1995 Kikuchi et al. ..... 399/381

(Continued)

FOREIGN PATENT DOCUMENTS

JP 2-110083 A 4/1990

(Continued)

OTHER PUBLICATIONS

Definition of "module". Webster's Third New International Dictionary, Unabridged (1993).*

*Primary Examiner*—Patrick Mackey
*Assistant Examiner*—Jeremy Severson
(74) *Attorney, Agent, or Firm*—Birch, Stewart, Kolasch & Birch, LLP

(57) ABSTRACT

Mechanism unit(s) functioning as automatic-feed cassette(s) and mechanism unit(s) functioning as manual-feed tray(s) together form a single integral module, constituting a hybrid paper supply module. In such constitution, paper transport path(s) may be formed between or among first guide member(s) provided at automatic-feed cassette mechanism unit(s) and second guide member(s) provided at manual-feed mechanism unit(s), and manual-feed mechanism unit(s) may be pulled outward and to side(s) of apparatus(es) so as to cause paper transport path(s) to be opened up to the exterior, facilitating removal of jammed paper. Furthermore, given such constitution, a plurality of hybrid paper supply modules may be stacked together to constitute a paper supply mechanism. Manual-feed tray(s) with which manual-feed mechanism unit(s) of respective hybrid paper supply module(s) is or are provided may be collapsible so as to permit extension and/or retraction. This will permit manual-feed tray(s) to be able to accommodate a plurality of types of recording media.

8 Claims, 14 Drawing Sheets

U.S. PATENT DOCUMENTS

| | | | | |
|---|---|---|---|---|
| 6,135,438 | A * | 10/2000 | Newman et al. | 271/9.07 |
| 6,246,860 | B1 * | 6/2001 | Ohmichi | 399/406 |
| 6,332,609 | B1 * | 12/2001 | Arakawa | 271/157 |
| 6,496,281 | B1 * | 12/2002 | Yamamoto et al. | 358/401 |
| 2005/0051942 | A1 * | 3/2005 | Kubo et al. | 271/9.09 |
| 2005/0074266 | A1 * | 4/2005 | Hiramoto et al. | 399/391 |

FOREIGN PATENT DOCUMENTS

| | | | |
|---|---|---|---|
| JP | 6-329306 | A | 11/1994 |
| JP | 2001-138576 | A | 5/2001 |
| JP | 2001-333249 | A | 11/2001 |
| JP | 2002167083 | A * | 6/2002 |

* cited by examiner

HYBRID PAPER SUPPLY MODULE AND IMAGE FORMING APPARATUS EQUIPPED WITH SUCH HYBRID PAPER SUPPLY MODULE, AND ALSO PAPER SUPPLY MECHANISM AND IMAGE FORMING APPARATUS EQUIPPED WITH SUCH PAPER SUPPLY MECHANISM

BACKGROUND OF INVENTION

This application claims priority under 35 USC 119(a) to Patent Application No. 2003-344584 and Patent Application No. 2003-344585, both of which were filed in Japan on 2 Oct. 2003, the content of both which is incorporated herein by reference in its entirety.

The present invention relates to a paper supply module with which a copier, printer, facsimile machine, or other such image forming apparatus might be equipped, and to an image forming apparatus equipped with such a paper supply module; and also to a paper supply mechanism with which same might be equipped, and to an image forming apparatus equipped with such a paper supply mechanism. In particular, the present invention relates to improvements in paper supply modules and paper supply mechanisms constructed so as to permit reduction in the amount of space required for image forming apparatus installation and/or reduction in the frequency of occurrence of paper jams.

Copiers, printers, facsimile machines, and other such image forming apparatuses—as well as hybrid devices equipped with a plurality of such functions in combination—have conventionally been equipped with automatic-feed cassettes and manual-feed trays serving as containers for (platforms for placement of) recording paper to be fed to image forming units (printing units) equipped with photosensitive drums and the like. When several hundred sheets of recording paper are, for example, loaded into an automatic-feed cassette and image formation is carried out on this recording paper, the recording paper might be sequentially taken up from the automatic-feed cassette and fed to an image forming unit. On the other hand, when a user places recording paper (e.g., postcard stock or the like) on a manual-feed tray and causes initiation of image forming operations, recording paper on this manual-feed tray might be fed to an image forming unit.

Image forming apparatuses equipped with such automatic-feed cassette(s) and manual-feed tray(s) are, for example, disclosed at Japanese Patent Application Publication Kokai No. 2001-138576 and Japanese Patent Application Publication Kokai No. 2001-333249. As disclosed at these references, the automatic-feed cassette has heretofore typically been provided at the lowermost part of the apparatus, with the paper supply path extending from the discharge side of this automatic-feed cassette to the image forming unit. Furthermore, the manual-feed tray, being attached to a side wall of the image forming apparatus, has communicated with an intermediate location along the foregoing paper supply path by way of a paper pickup mechanism for taking up recording paper from this manual-feed tray.

FIG. 14 shows in schematic fashion the internal constitution of a typical conventional copier. At this FIG. 14, a is an automatic-feed cassette; b is a manual-feed tray; c is an image forming unit equipped with a photosensitive drum and so forth; d is a paper supply path extending from automatic-feed cassette a; and e is a paper pickup mechanism for taking up recording paper from manual-feed tray b.

As can be seen in FIG. 14, in the case of a paper supply system having layout as mentioned above in which automatic-feed cassettes a are provided at the lowermost part of an image forming apparatus and manual-feed tray b is provided at a side wall of the image forming apparatus, paper pickup mechanism e for manual-feed tray b is arranged to one side of paper supply path d (i.e., at the side thereof nearer to the apparatus side wall), and paper supply path d extends from automatic-feed cassette a so as to be directed toward image forming unit c; meaning that manual-feed tray b will, moreover, be arranged to one side of paper pickup mechanism e. In other words, the aforementioned paper pickup mechanism e and manual-feed tray b are arranged, in that order as one goes toward the exterior horizontally, to one side of paper supply path d; the presence of these meaning that there has been a limit to the degree to which it has been possible to reduce the amount of space required for installation of the image forming apparatus. In the case of this image forming apparatus shown in FIG. 14, were it not for manual-feed tray b and paper pickup mechanism e the amount of space required for installation of the apparatus would only be dimension I shown in the drawing, but due to the fact that manual-feed tray b and paper pickup mechanism e are actually present the amount of space required for installation of the apparatus is dimension II.

At the same time, developments have in recent years been underway in efforts to achieve reduction in the amount of space required for installation of the apparatus by arranging the automatic-feed cassette at the lower portion of the apparatus and arranging the original capturing unit (scanning unit) at the upper portion of the apparatus, and by disposing the image forming unit and discharge unit (discharge tray) between this automatic-feed cassette and this original capturing unit so as to avoid situations in which the discharge tray protrudes from the side of the apparatus.

FIG. 15 shows in schematic fashion an image forming apparatus having such a layout. At this FIG. 15 as well, a is an automatic-feed cassette; b is a manual-feed tray; c is an image forming unit; d is a paper supply path; and e is a paper pickup mechanism. In the case of an image forming apparatus having such a layout, because the aforementioned paper pickup mechanism e and manual-feed tray b are arranged, in that order as one goes toward the exterior horizontally, at the peripheral region near the side wall of the apparatus, as was the case in the above situation there has here as well been a limit to the degree to which it has been possible to reduce the amount of space required for installation.

In particular, given such a layout, it will be necessary to arrange flipping transport path (switchback transport path) f, for flipping of recording media when carrying out double-sided printing, to one side of paper supply path d. And in the case of a layout in which the aforementioned paper pickup mechanism e and manual-feed tray b are arranged even further to the side than this flipping transport path f, because the space required for installation of the apparatus will increase by an amount corresponding thereto, it has not been possible to take full advantage of the reduction in installation space that would otherwise be afforded by the aforementioned layout (i.e., layouts having the intention of avoiding situations in which the discharge tray protrudes from the side of the apparatus). At this FIG. 15 as well, the amount of space that would be required for installation were it not for manual-feed tray b and paper pickup mechanism e is indicated by I, and the amount of space required for installation of the apparatus due to the fact that manual-feed tray b and paper pickup mechanism e are present is indicated by II.

Furthermore, the paper supply path in heretofore-developed image forming apparatuses has been such that the transport path for recording paper supplied from the automatic-feed cassette and the transport path for recording paper supplied from the manual-feed tray have intersected at a location immediately upstream from the image forming unit, and the overall paper supply path of the image forming apparatus has been quite long, increasing by a corresponding amount the complexity of the internal constitution within the apparatus main body as well as the number of locations at which paper jams can occur, and making reduction in the frequency of occurrence of paper jams difficult.

The present invention was conceived in light of such issues, it being an object thereof to provide a hybrid paper supply module permitting reduction in the amount of space required for image forming apparatus installation as well as reduction in the frequency of occurrence of paper jams, and an image forming apparatus equipped with such hybrid paper supply module(s).

SUMMARY OF INVENTION

Solution means employed by one or more embodiments of the present invention for achieving the foregoing and/or other object(s), in the context of a hybrid paper supply module in which automatic-feed cassette mechanism unit(s) and manual-feed mechanism unit(s) constitute a single module, is such that movement of manual-feed mechanism unit(s) relative to automatic-feed cassette mechanism unit(s) may cause transport path(s) within hybrid paper supply module(s) to be opened up to the exterior so as to permit easy removal of jammed paper.

More specifically, one or more embodiments of the present invention may be predicated upon a hybrid paper supply module comprising one or more automatic-feed cassette mechanism units capable of containing one or more recording media for image formation to be carried out at one or more image forming units of one or more image forming apparatuses; and one or more manual-feed mechanism units permitting placement therein or thereon of one or more recording media by one or more users; wherein at least one of the automatic-feed cassette mechanism unit or units and at least one of the manual-feed mechanism unit or units constitute a single module. At such a hybrid paper supply module, at least one of the manual-feed mechanism unit or units may be installed in such fashion as to allow movement so as to permit one or more recording medium transport paths within the hybrid paper supply module to be opened up to the exterior. Furthermore, at least one of the manual-feed mechanism unit or units may be equipped with at least one manual-feed tray which is capable of being stored at at least one side of the hybrid paper supply module when not in use. Moreover, at least one of the manual-feed tray or trays may be equipped with at least one deployment grip region and/or at least one opening grip region. Deployment grip region(s) may be grabbed in one or more procedures carried out by one or more users when causing manual-feed tray(s) to assume deployed state(s) permitting placement therein or thereon of recording medium or media by user(s); opening grip region(s) may be grabbed in one or more procedures carried out by user(s) when causing recording medium transport path(s) to be opened up to the exterior.

As a result of such specific features, firstly, when image formation is to be carried out with paper being supplied from manual-feed mechanism unit(s), user(s) may grab deployment grip region(s) and may, for example, cause manual-feed tray(s) to pivot or the like, causing manual-feed tray(s) to assume deployed state(s). This makes it possible for user(s) to be able to place recording medium or media in or on manual-feed tray(s), permitting image forming operations to be carried out with paper being supplied in manual-feed fashion. And in the event that paper jam(s) occur at interior(s) of hybrid paper supply module(s), user(s) may grab opening grip region(s) and may, for example, cause manual-feed tray(s) to be pulled out from image forming apparatus(es) so as to cause recording medium transport path(s) at interior(s) of hybrid paper supply module(s) to be opened up to the exterior. This makes it possible for user(s) to be able to insert his or her or their hand(s) into space(s) that have opened up, permitting easy removal of jammed paper.

The following may be presented as more specific examples of such constructions. That is, automatic-feed cassette mechanism unit(s) and manual-feed mechanism unit(s) may be contained within hybrid paper supply module casing(s). In addition, at least one of the automatic-feed cassette mechanism unit or units may be installed so as to be capable of being pulled out from at least one of the module casing or casings when directed toward at least one front of at least one of the image forming apparatus or apparatuses. Furthermore, at least one of the manual-feed mechanism unit or units may be installed so as to be capable of being pulled out from at least one of the module casing or casings when directed toward at least one side of at least one of the image forming apparatus or apparatuses, at least one of the opening grip region or regions being grabbed in one or more procedures carried out by one or more users during pulling out thereof. That is, during replenishment of recording medium or media at automatic-feed cassette mechanism unit(s), such automatic-feed cassette mechanism unit(s) may be pulled out toward front(s) of image forming apparatus(es); and in the event that paper jam(s) occur at interior(s) of hybrid paper supply module(s), user(s) may carry out procedure(s) in which opening grip region(s) is/are grabbed so as to cause manual-feed mechanism unit(s) to be pulled out toward side(s) of image forming apparatus(es). Because manual-feed mechanism unit(s) can thus be moved (pulled out) independently from automatic-feed cassette mechanism unit(s), forming space(s) for removal of jammed paper, it is possible to ensure that such space(s) will be relatively large, facilitating procedure(s) for removal of jammed paper.

The following may be presented as more specific example(s) of construction(s) for forming such space(s) for removal of jammed paper. That is, a hybrid paper supply module according to one or more embodiments of the present invention may further comprise at the interior thereof one or more first paths transporting one or more recording media taken up from at least one of the automatic-feed cassette mechanism unit or units; one or more second paths transporting one or more recording media taken up from at least one of the manual-feed mechanism unit or units; and one or more common paths at which at least one of the first path or paths and at least one of the second paths are made to mutually intersect and which thereafter extend toward at least one of the image forming unit or units. Moreover, the constitution may be such that, of the respective paths, at least one of at least the common path or paths is opened up to the exterior when at least one of the manual-feed mechanism unit or units is moved in accompaniment to at least one procedure in which at least one of the opening grip region or regions is grabbed.

In such case, at least one of the common path or paths may be formed by one or more spaces between or among one or more first guide members provided at at least one of the automatic-feed cassette mechanism unit or units and one or more second guide members provided at at least one of the manual-feed mechanism unit or units; and in accompaniment to movement of at least one of the manual-feed mechanism unit or units, at least one of the second guide member or members may move away from at least one of the first guide member or members, causing at least one of the common path or paths to be opened up to the exterior.

As a result of such specific features, it will be possible to cause common path(s) to be opened up to the exterior merely by carrying out procedure(s) in which manual-feed mechanism unit(s) is/are moved (pulled out), making it possible to form space(s) for removal of jammed paper by means of simple procedure(s). This being the case, it will be possible to achieve reduction in the time from occurrence of a paper jam to the time when such jammed paper is removed and it will be possible to more quickly return to image forming operations.

Moreover, also within the purview of the technical idea of the present invention are image forming apparatus(es) equipped with hybrid paper supply module(s) in accordance with any one among the foregoing respective solution means. That is, in such an image forming apparatus, image formation would be carried out on one or more recording media supplied to at least one of the image forming unit or units from at least one of the automatic-feed cassette mechanism unit or units or at least one of the manual-feed mechanism unit or units.

As described above, in accordance with one or more embodiments of the present invention in which mechanism unit(s) functioning as automatic-feed cassette(s) and mechanism unit(s) functioning as manual-feed tray(s) together form an integral module, constituting a hybrid paper supply module, movement of manual-feed mechanism unit(s) relative to automatic-feed cassette mechanism unit(s) may cause transport path(s) within hybrid paper supply module(s) to be opened up to the exterior. This being the case, in the event of occurrence of paper jam(s), it will be possible for user(s) to insert his or her or their hand(s) into space(s) that have opened up and easily remove jammed paper, simplification of procedure(s) for removal of jammed paper permitting concomitant increase in ability to quickly return to image forming operations.

Incorporating manual-feed mechanism unit(s) and automatic-feed cassette mechanism unit(s) into a single integral structure makes it possible for manual-feed mechanism unit(s) to be arranged so as to be stacked vertically with respect to transport path(s) extending so as to be directed toward image forming unit(s) of image forming apparatus(es), as a result of which it is possible to shorten dimension(s) of image forming apparatus(es) and achieve reduction in the amount of space required for installation.

Furthermore, solution means employed by one or more embodiments of the present invention for achieving the foregoing and/or other object(s), in the context of a paper supply mechanism formed by stacking together hybrid paper supply modules, each of a plurality of which has automatic-feed cassette mechanism unit(s) and manual-feed mechanism unit(s) constituting a single module, may be such that manual-feed tray(s) provided at manual-feed mechanism unit(s) at each individual hybrid paper supply module is/are collapsible so as to permit extension and/or retraction. This makes it possible for each such manual-feed tray to be able to accommodate a plurality of types of recording media.

More specifically, one or more embodiments of the present invention may be predicated upon a paper supply mechanism comprising a plurality of hybrid paper supply modules that are stacked together; each of a plurality of the hybrid paper supply modules having one or more automatic-feed cassette mechanism units capable of containing one or more recording media for image formation to be carried out at one or more image forming units of one or more image forming apparatuses; and one or more manual-feed mechanism units permitting placement therein or thereon of one or more recording media by one or more users; at least one of the automatic-feed cassette mechanism unit or units and at least one of the manual-feed mechanism unit or units constituting a single module. This paper supply mechanism may be such that at least one of the manual-feed mechanism unit or units of each of the hybrid paper supply modules is respectively equipped with at least one manual-feed tray permitting placement therein or thereon of one or more recording media by one or more users; and such that each of a plurality of the manual-feed trays can be collapsed so as to decrease at least one total length thereof and permit storage thereof at at least one side of at least one of the hybrid paper supply modules when not in use.

As a result of such specific features, when image forming operation(s) is/are carried out with paper being supplied in manual-feed fashion, it is possible for any hybrid paper supply module(s) between or among the plurality of hybrid paper supply modules making up the paper supply mechanism to be selected, it is possible to cause manual-feed tray(s) of manual-feed mechanism unit(s) provided at such selected hybrid paper supply module(s) to be deployed and/or to be extended to length(s) such as will permit placement therein or thereon of recording medium or media, after which recording medium or media can be placed therein or thereon. Furthermore, when such manual-feed tray(s) is/are to be stored at side(s) of hybrid paper supply module(s), such manual-feed tray(s) may be collapsed so as to decrease total length(s) thereof, permitting such manual-feed tray(s) to be stored in more or less parallel fashion with respect to side(s) of hybrid paper supply module(s). Accordingly, while total length(s) thereof may be decreased when manual-feed tray(s) is/are in such stored state(s), it is nonetheless possible during usage thereof (i.e., when recording medium or media is/are to be placed therein or thereon) to increase total length(s) thereof to extent(s) sufficient to prevent such recording medium or media from falling therefrom. All of the hybrid paper supply modules may be provided with such capability, permitting user(s) to, regardless of which recording medium size(s) is/are to be used, utilize any arbitrary hybrid paper supply module(s) to carry out manual paper feed.

The following may be presented as more specific examples of such constructions. That is, each of a plurality of the manual-feed trays may be constituted such that, upon being deployed after being stored at at least one side of at least one of the hybrid paper supply modules, placement therein or thereon of one or more recording media by one or more users is made possible and access is opened up to one or more recording medium transport paths at at least one of the manual-feed mechanism unit or units. Furthermore, access to recording medium transport path(s) may be opened up simultaneous with deployment of manual-feed tray(s) and access to recording medium transport path(s) may be closed off simultaneous with storage of manual-feed tray(s). This makes for good ease of operations at time(s) when manual-feed tray(s) is/are put into use and at time(s) when manual-feed tray(s) is/are put away.

Furthermore, each of a plurality of the manual-feed trays, may, when stored at at least one side of at least one of the hybrid paper supply modules, serve to constitute at least one portion of at least one side wall of at least one of the hybrid paper supply modules; and may, when deployed after being stored at at least one side of at least one of the hybrid paper supply modules, serve to constitute at least one platform permitting placement therein or thereon of one or more recording media. Because manual-feed tray(s) may thus also function as member(s) making up module side wall(s), it will be possible to achieve reduction in the total parts count of the image forming apparatus.

Furthermore, each of a plurality of the manual-feed trays may be equipped with at least one auxiliary tray capable of extending total tray length when made to assume at least one deployed state after being in at least one state in which it was stored at at least one side of at least one of the hybrid paper supply modules. In such case, at least one operation in which total tray length is extended by means of at least one of the auxiliary tray or trays may occur by means of at least one manual procedure performed by one or more users. Such solution means makes it possible to easily cause total length(s) of manual-feed tray(s) to be varied in correspondence to size(s) of recording medium or media placed therein or thereon, permitting manual-feed mechanism unit(s) to accommodate recording media of multiple sizes.

Moreover, the constitution may be such that at least one operation for causing at least one of the manual-feed trays to be deployed from at least one state in which it had been stored at at least one side of at least one of the hybrid paper supply modules occurs by means of at least one manual procedure performed by one or more users or at least one automatic operation performed by at least one automatic deployment mechanism. When manual-feed tray(s) is/are deployed by means of manual procedure(s) performed by user(s), this makes it possible for user(s) to consciously select hybrid paper supply module(s) that is/are to be used; and when manual-feed tray(s) is/are deployed by means of automatic operation(s), because this eliminates the need for user(s) to perform procedure(s) for opening/closing manual-feed tray(s), ease of use of the apparatus is improved.

Moreover, also within the purview of the technical idea of the present invention are image forming apparatus(es) equipped with paper supply mechanism(s) in accordance with any one among the aforementioned respective solution means. That is, in such an image forming apparatus, image formation would be carried out on one or more recording media supplied to at least one of the image forming unit or units after being taken up from at least one of the automatic-feed cassette mechanism unit or units or at least one of the manual-feed mechanism unit or units of at least one of the paper supply modules.

One or more embodiments of the present invention, in the context of a paper supply mechanism formed by stacking together hybrid paper supply modules, each of a plurality of which has automatic-feed cassette mechanism unit(s) and manual-feed mechanism unit(s) constituting a single module, is such that manual-feed tray(s) provided at manual-feed mechanism unit(s) at each individual hybrid paper supply module is/are collapsible so as to permit extension and/or retraction. This being the case, it will be possible for user(s) to, regardless of which recording medium size(s) is/are to be used, utilize any arbitrary hybrid paper supply module(s) to carry out manual paper feed; and it will be possible to improve practical applicability when a plurality of such hybrid paper supply modules are used in combination.

As has been described above, because in one or more embodiment(s) of the present invention it is possible to constitute the foregoing hybrid paper supply module(s) and/or paper supply mechanism(s), manual-feed mechanism unit(s) may be arranged so as to be stacked vertically with respect to flipping transport path(s) and main transport path(s) extending so as to be directed toward printing unit(s) of hybrid device(s), as a result of which it is possible to shorten dimension(s) of hybrid device(s) and achieve reduction in the amount of space required for installation.

Furthermore, the foregoing hybrid paper supply module(s) and/or paper supply mechanism(s) make it possible to cause path(s) along which recording paper taken up from automatic-feed cassette mechanism unit(s) is/are transported and path(s) along which recording paper taken up from manual-feed mechanism unit(s) is/are transported to intersect at interior(s) of module(s), and makes it possible to decrease length(s) of respective path(s). This being the case, the length of the overall paper transport path of the apparatus can be shortened, the number of locations at which paper jams can occur can be reduced, and image forming operations at the apparatus can be carried out in stable fashion.

DESCRIPTION OF PREFERRED EMBODIMENTS

First Embodiment

The following embodiment of the present invention is described with reference to the drawings. At the present embodiment, description is carried out in terms of an example in which the present invention is applied to a hybrid device equipped with copier function, printer function, and facsimile function.

—Description of Overall Constitution of Hybrid Device—

Figure 1:
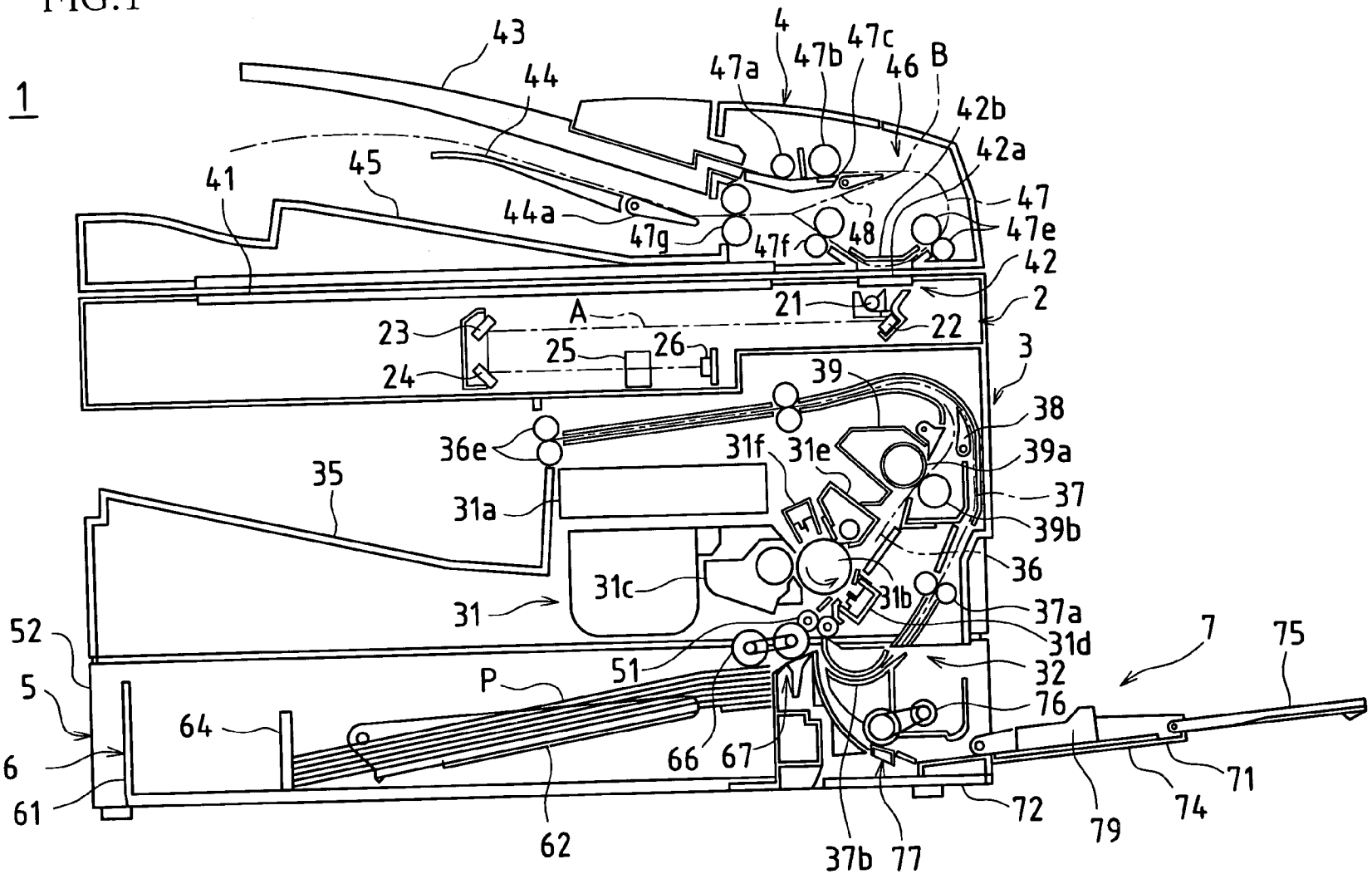
FIG. 1 is a drawing showing in schematic fashion the internal constitution of a hybrid device associated with an embodiment of the present invention.

FIG. 1 shows in schematic fashion the internal constitution of hybrid device 1 which serves as image forming apparatus associated with the present embodiment. As shown in this FIG. 1, hybrid device 1 is provided with scanning unit 2, printing unit 3 serving as image forming unit, and automatic original feed unit 4. Description of the respective units follows below.

Description of Scanning Unit 2

At the subassembly represented by scanning unit 2, images of originals placed on original stage 41 comprising transparent glass or the like and/or images of originals fed one at a time from automatic original feed unit 4 are captured and image data is created. This scanning unit 2 is provided with exposing light source 21; plurality of reflecting mirrors 22, 23, 24; imaging lens 25; and photoelectric conversion element (CCD=charge coupled device) 26.

The aforementioned exposing light source 21 causes light to be irradiated onto originals placed on original stage 41 of automatic original feed unit 4 and/or originals transported thereto by automatic original feed unit 4. As indicated by the optical axis depicted using alternating long and short chain line A at FIG. 1, respective reflecting mirrors 22, 23, 24 cause light reflected from the original to first be reflected to the left as viewed in the drawing, to thereafter be reflected downward, and to thereafter be reflected to the right as viewed in the drawing so as to be directed toward imaging lens 25.

Operations for capturing an original image are such that, in the situation where the original is placed on the aforementioned original stage 41 (i.e., during stationary sheet operation), exposing light source 21 and respective reflecting mirrors 22, 23, 24 scan horizontally in parallel fashion with respect to original stage 41 so as to capture an image of the entire original. On the other hand, in the situation where the original is transported by automatic original feed unit 4 (i.e., during moving sheet operation), exposing light source 21 and respective reflecting mirrors 22, 23, 24 remain stationary at the position indicated at FIG. 1, and original capturing unit 42 of automatic original feed unit 4, described below, is made to capture an image of the original when the original passes therethrough.

Light reflected by the aforementioned respective reflecting mirrors 22, 23, 24 and passing through imaging lens 25 is guided to photoelectric conversion element 26, the reflected light being converted into electrical signal(s) (original image data) at this photoelectric conversion element 26.

Description of Printing Unit 3

Printing unit 3 is provided with image forming system 31 and paper transport system 32.

Image forming system 31 is provided with laser scanning unit 31*a* and photosensitive drum 31*b* serving as drum-type image carrier. Laser scanning unit 31*a* irradiates the surface of photosensitive drum 31*b* with laser light based on original image data produced by conversion at the aforementioned photoelectric conversion element 26. Photosensitive drum 31*b* rotates in the direction indicated by the arrow in FIG. 1, and a latent electrostatic image is formed on the surface thereof as a result of irradiation thereof by laser light from laser scanning unit 31*a*.

Furthermore, at the outside periphery of photosensitive drum 31*b*, there are arranged in order circumferentially thereabout—in addition to the aforementioned laser scanning unit 31*a*—developer apparatus (developer mechanism) 31*c*, transfer unit 31*d* constituting a transfer mechanism, cleaning apparatus (cleaning mechanism) 31*e*, a charge-removing unit (not shown), and charging unit 3*f*. Developer apparatus 31*c* uses toner (i.e., a substance for making the latent image manifest) to develop the latent electrostatic image formed on the surface of photosensitive drum 31*b* and produce a visible image. Transfer unit 31*d* transfers the toner image formed on the surface of photosensitive drum 31*b* onto recording paper P, which serves as recording medium. Cleaning apparatus 31*e* removes toner residue from the surface of photosensitive drum 31*b* following toner transfer. The charge-removing unit removes any charge remaining on the surface of photosensitive drum 31*b*. Charging unit 31*f* charges the surface of photosensitive drum 31*b* to a prescribed electric potential prior to formation of the latent electrostatic image.

When forming an image on recording paper P, therefore, charging unit 3*f* causes the surface of photosensitive drum 31*b* to be charged to a prescribed electric potential, and laser scanning unit 31*a* irradiates the surface of photosensitive drum 31*b* with laser light based on original image data. Developer apparatus 31*c* then develops a visible toner image on the surface of photosensitive drum 31*b*, and transfer unit 31*d* causes the toner image to be transferred to recording paper P. In addition, cleaning apparatus 31*e* then removes toner residue from the surface of photosensitive drum 31*b*, and the charge-removing unit removes any charge remaining on the surface of photosensitive drum 31*b*. This concludes one cycle of image forming operations (printing operations) carried out on recording paper P. By repeating this cycle, it is possible to continuously carry out image formation on a plurality of sheets of recording paper P.

Furthermore, paper transport system 32 transports recording paper P one sheet at a time from automatic-feed cassette mechanism unit 6 or manual-feed mechanism unit 7 which are provided at hybrid paper supply module 5, described below, so as to permit image formation by the aforementioned image forming system 31, and also discharges recording paper P to discharge tray 35 serving as paper discharge unit after image(s) have been formed thereon.

This paper transport system 32 is provided with main transport path 36 and flipping transport path 37. One end of main transport path 36 opposes the discharge side of hybrid paper supply module 5, and the other end thereof opposes discharge tray 35. One end of flipping transport path 37 is connected to main transport path 36 at a point upstream from (below, in the drawing) the location at which transfer unit 31*d* is installed, and the other end thereof is connected to main transport path 36 at a point downstream from (above, in the drawing) the location at which transfer unit 31*d* is installed. Moreover, in the present embodiment, a portion of flipping transport path 37 passes through the interior of hybrid paper supply module 5. For this reason, guide member 37*b*, for forming flipping transport path 37, is provided at the interior of this hybrid paper supply module 5.

In addition, by driving the aforementioned automatic-feed cassette mechanism unit 6 or manual-feed mechanism unit 7, it is possible to cause recording paper P to be fed in intermittent fashion, one sheet at a time, toward printing unit 3 from either mechanism unit 6,7.

Registration roller(s) 51, provided at hybrid paper supply module 5, is/are arranged at a point upstream from the location at which transfer unit 31*d* is installed in the aforementioned main transport path 36. These registration rollers 51 transport recording paper P while aligning recording paper P with the toner image on the surface of photosensitive drum 31*b*. Installed at a point downstream from the location at which transfer unit 31*d* is installed in this main transport path 36 is fuser apparatus 39, which is provided with a pair of fuser rollers 39*a*, 39*b*. Moreover, installed at the downstream end of main transport path 36 is/are discharge roller(s) 36*e* for discharging recording paper P into discharge tray 35.

Arranged at a location at the top end of flipping transport path 37, where flipping transport path 37 joins main transport path 36, is diverter paddle 38. This diverter paddle 38 is capable of being rotated about a horizontal axis between a first position indicated by the solid line in FIG. 1 and a second position which is arrived at as a result of counterclockwise rotation as viewed in the drawing from the first position and which causes access to be opened up to flipping transport path 37. When this diverter paddle 38 is in its first position, recording paper P is transported toward discharge tray 35; and when it is in its second position, it permits recording paper P to be supplied to flipping transport path 37. Transport roller(s) 37*a* is/are arranged in flipping transport path 37; and when recording paper P is supplied to flipping transport path 37 (i.e., when recording paper P is supplied to flipping transport path 37 pursuant to "switchback transport"), recording paper P is transported by these transport rollers 37*a*, recording paper P being flipped at a location upstream of registration rollers 51, and being again transported along main transport path 36 toward transfer unit 31*d*. That is, arrangements are made to permit image formation to be carried out on the back of recording paper P.

Description of Automatic Original Feed Unit 4

Automatic original feed unit 4 will next be described. This automatic original feed unit 4 is constructed so as to permit it to serve as "automatic double-sided original transport apparatus." This automatic original feed unit 4 is capable of being used for moving sheet operation, and is provided with original loading unit(s) comprising original tray 43 and intermediate tray 44 and original discharge tray 45 serving as original discharge unit, and original transport system 46 for transporting originals between respective trays 43, 44, 45.

The aforementioned original transport system 46 is provided with main transport path 47 for transporting original(s) placed in or on original tray 43 to intermediate tray 44 and/or original discharge tray 45 by way of original capturing unit 42; and auxiliary transport path 48 for supplying original(s) to main transport path 47 from intermediate tray 44.

Arranged at the upstream end of main transport path 47 (at a region opposing the discharge side of original tray 43) are original takeup roller(s) 47*a* and separator roller(s) 47*b*. Arranged below separator roller(s) 47*b* is/are separator plate(s) 47*c*, and in accompaniment to rotation of takeup roller 47*a*, one sheet from among the original(s) in original tray 43 is made to pass between this separator roller 47*b* and this separator plate 47*c*, and is supplied to main transport path 47. Arranged at a location downstream of the intersection (region B in the drawing) of main transport path 47 and auxiliary transport path 48 are PS rollers 47*e*, 47*e*. These PS rollers 47*e*, 47*e* supply originals to original capturing unit 42 such that the leading edge of the original is coordinated with the timing with which image capture occurs at scanning unit 2. That is, upon supply of an original thereto, these PS rollers 47*e*, 47*e* temporarily stop transport of the original so as to permit adjustment of the aforementioned timing before supplying the original to original capturing unit 42.

Original capturing unit 42 is provided with glass platen 42*a* and original backpressure plate 42*b*, and when an original supplied thereto by PS rollers 47*e*, 47*e* passes between glass platen 42*a* and original backpressure plate 42*b*, light from the aforementioned exposing light source 21 passes through glass platen 42*a* and irradiates the original. At this time, acquisition of original image data by the aforementioned scanning unit 2 occurs. A restoring force from a oil spring, not shown, is imparted to the back (top) of the aforementioned original backpressure plate 42*b*. This causes original backpressure plate 42*b* to press against and contact glass platen 42*a* with a prescribed force so as to discourage the original from lifting up off of glass platen 42*a* as the original passes through original capturing unit 42.

Provided downstream from glass platen 42*a* are transport rollers 47*f* and original discharge rollers 47*g*. The constitution is such that upon passing over glass platen 42*a*, original(s) is/are discharged to intermediate tray 44 and/or original discharge tray 45 by way of transport rollers 47*f* and original discharge rollers 47*g*.

Arranged between original discharge rollers 47*g* and intermediate tray 44 is intermediate tray pivot plate 44*a*. The pivoting motion of this intermediate tray pivot plate 44*a* being centered on the end thereof which is nearer to intermediate tray 44, intermediate tray pivot plate 44*a* is capable of pivoting between a first position indicated by the solid line in the drawing and a second position arrived at when swung upward from the first position. When intermediate tray pivot plate 44*a* is in its second position, originals discharged by original discharge rollers 47*g* are recovered into original discharge tray 45. On the other hand, when intermediate tray pivot plate 44*a* is in its first position, originals discharged by original discharge rollers 47*g* are discharged into intermediate tray 44. When an original is discharged to this intermediate tray 44, the edge of the original is held in the nip between original discharge rollers 47*g*, 47*g*; and with the original in this state, original discharge rollers 47*g* then rotate in reverse fashion, causing the original to be supplied to auxiliary transport path 48, and after traveling through this auxiliary transport path 48, the original is again delivered to main transport path 47. Operations whereby these original discharge rollers 47*g* are made to rotate in reverse fashion are carried out such that delivery of the original to main transport path 47 is coordinated with the timing with which image capture occurs. This make it possible for original capturing unit 42 to capture an image of the back of the original.

—Description of Basic Operation of Hybrid Device—

Among the operations carried out by hybrid device 1 having the foregoing constitution, hybrid device 1—firstly when functioning as a printer—receives print data (image data and/or text data) sent thereto from a personal computer or other such host device, and temporarily stores this received print data in buffer(s) (memory or memories), not shown. Along with such storage of print data to buffer, print data is sequentially read from buffer; and based on the print data read therefrom, image formation is carried out on recording paper P by virtue of image forming operations taking place at the aforementioned printing unit 3.

Furthermore, when functioning as a scanner, hybrid device 1 temporarily stores, in buffer(s), scan image data of original(s) captured by the aforementioned scanning unit 2. Along with such storage of scan image data to buffer, scan image data is sequentially sent from buffer to host apparatus, image(s) thereof being displayed on a display or the like at this host apparatus. Note that when hybrid device 1 functions as a facsimile device, this scan image data would be sent to a regular public line.

Moreover, when functioning as a copier, hybrid device 1 temporarily stores, in buffer(s), image formation is carried out on recording paper P by virtue of image forming operations taking place at printing unit 3 based on original image data captured by means of the foregoing scanner function.

—Description of Hybrid Paper Supply Module 5—

Figure 2:
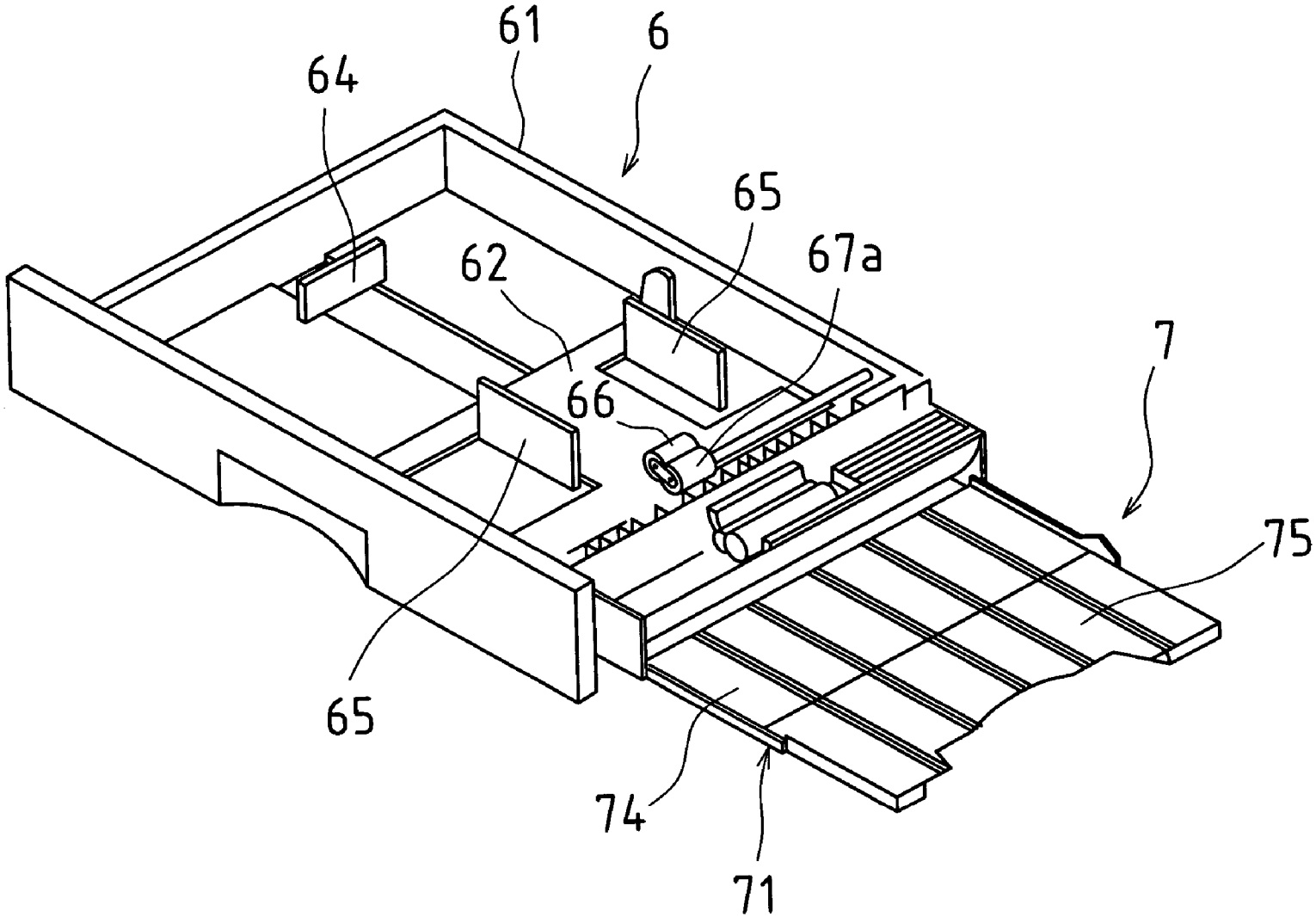
FIG. 2 is an oblique partial cutaway view of a hybrid paper supply module.

The aforementioned hybrid paper supply module 5, being a characteristic feature of the present embodiment, will next be described. FIG. 2 is an oblique partial cutaway view of automatic-feed cassette mechanism unit 6 and manual-feed mechanism unit 7 of hybrid paper supply module 5 provided at the present hybrid device 1. Furthermore, FIG. 3 is a drawing showing in schematic fashion a simplified rendering of the constitution at the interior of this hybrid paper supply module 5.

As shown in the respective drawings, hybrid paper supply module 5 is constructed such that the foregoing automatic-feed cassette mechanism unit 6 and manual-feed mechanism unit 7 are contained within module casing 52, which constitutes the housing of the present module 5. Moreover, whereas automatic-feed cassette mechanism unit 6 is provided with automatic-feed cassette 61 which is capable of storing a multiplicity of sheets (e.g., 500 sheets) of recording paper, manual-feed mechanism unit 7 is provided with manual-feed tray 71 which is such as to permit one or a small number of sheets of recording paper to be placed therein or thereon in a manual operation carried out by the user. In other words, this automatic-feed cassette 61 and this manual-feed tray 71 are contained within module casing 52, forming a single module and constituting the present hybrid paper supply module 5. Description of the respective mechanism units 6, 7 follows below.

Description of Automatic-Feed Cassette Mechanism Unit 6

Figure 3:
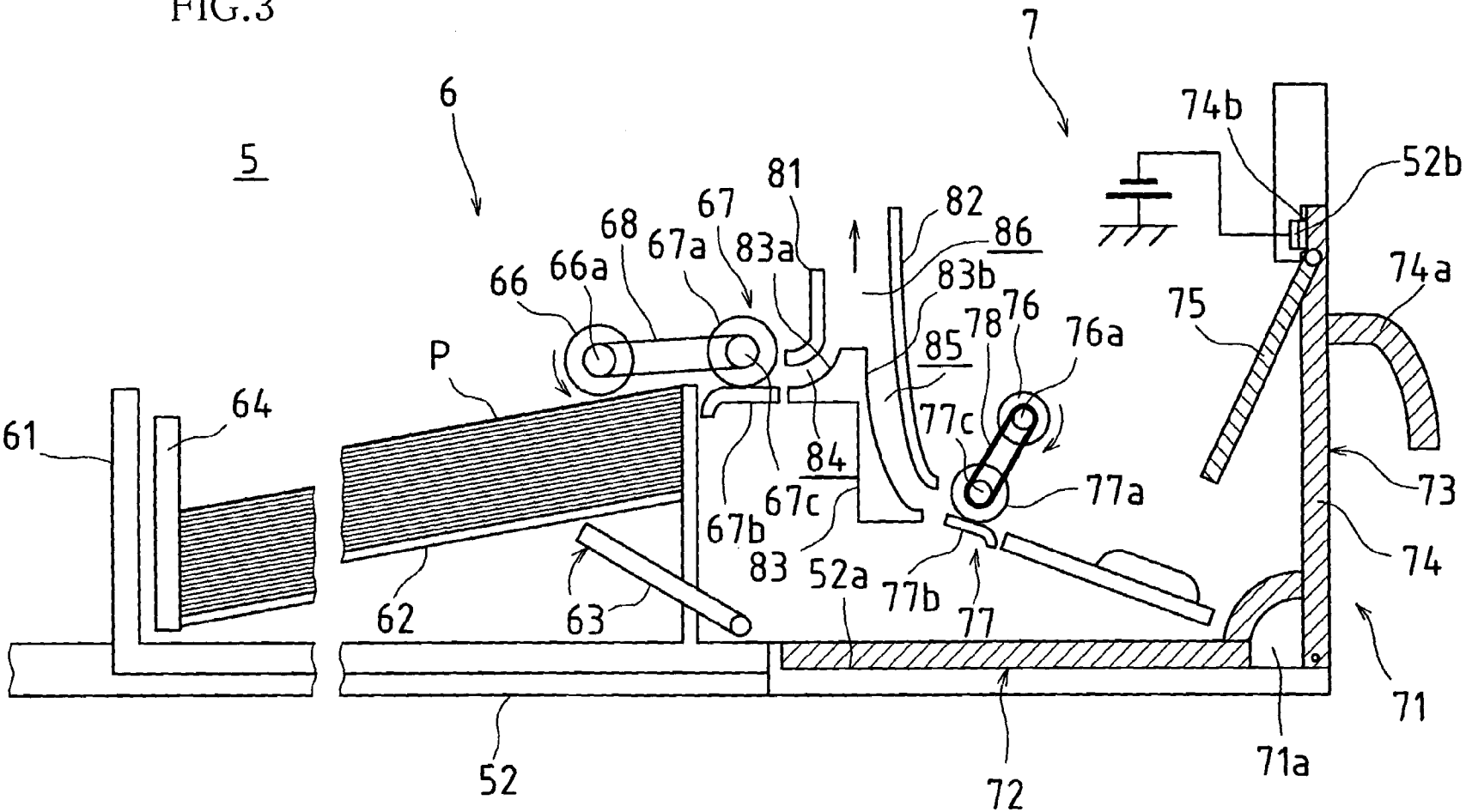
FIG. 3 is a drawing showing in schematic fashion a simplified rendering of the constitution at the interior of a hybrid paper supply module.

As shown in FIGS. 2 and 3, automatic-feed cassette mechanism unit 6 is provided with the aforementioned automatic-feed cassette 61 constructed in the form of a container which is open at the top; and pivotably supported at the interior of this automatic-feed cassette 61 is pivot plate 62, which is made of metal and serves as paper storage plate. In addition, this automatic-feed cassette 61 is capable of being pulled outward from the aforementioned module casing 52 and toward the front side (the near side at FIG. 1) of hybrid device 1, procedures for replenishing this automatic-feed cassette 61 with recording paper being made possible when this automatic-feed cassette 61 has been pulled outward therefrom.

The aforementioned pivot plate 62 is supported so as to permit it to pivot in a vertical direction about a pivot shaft extending in the direction of the width (i.e., perpendicular to the plane of the paper in FIG. 3) of automatic-feed cassette 61, and the bottom thereof is abutted by lift plate 63 which is imparted with an upward torque. In other words, as a result of the restoring force from lift plate 63, this pivot plate 62 is constantly acted upon by an upward restoring force. Note that a coil spring may be provided instead of this lift plate 63, in which case it would be the restoring force from the coil spring that would cause this pivot plate 62 to constantly be acted upon by an upward restoring force.

Furthermore, provided at one end (the right end in FIG. 3) within automatic-feed cassette 61 are paper lead edge alignment tabs, not shown, for pressing against the lead edge of recording paper P and aligning this recording paper P, and the corners of the lead edge of recording paper P are pressed downward from above by these paper lead edge alignment tabs. For this reason, when recording paper P is loaded within automatic-feed cassette 61, pivot plate 62 pivots upward due to the restoring force from lift plate 63, the rotational position thereof being constrained at the position at which the corners of the lead edge of recording paper P abut the paper lead edge alignment tabs. With automatic-feed cassette 61 in this state it is pushed into module casing 52; and as a result, a multiplicity of sheets of recording paper are loaded into automatic-feed cassette mechanism unit 6.

Furthermore, paper trail edge guide member 64, which positions the trail edge of recording paper P in the feed direction, is provided at the interior of the aforementioned automatic-feed cassette 61 in such manner as to permit sliding motion in parallel fashion with respect to the feed direction of recording paper P. Furthermore, also provided in such manner as to permit sliding motion are paper side edge guide members 65, 65 for positioning the two edges of recording paper P at sides perpendicular to the feed direction. Note that hybrid paper supply module 5 associated with the present embodiment stores recording paper P such that it is centered in the paper width direction. For this reason, respective paper side edge guide members 65, 65 are supported by a sliding mechanism, not shown, causing them to slide so as to mutually approach or recede in synchronous fashion.

Respectively provided at the paper discharge side of automatic-feed cassette mechanism unit 6 are paper separator mechanism 67 and takeup roller(s) 66 constituting a paper takeup mechanism.

The aforementioned paper separator mechanism 67 is equipped with separator roller(s) 67*a* and separator plate(s) 67*b*. Separator plate 67*b* is such that the force of friction between the top surface thereof (the surface coming in contact with recording paper P) and recording paper P is set so as to be greater than the force of friction between sheets of recording paper P, P. Furthermore, at separator roller 67*a*, the force of friction between this separator roller 67*a* and recording paper P is set so as to be greater than the force of friction between the top surface of separator plate 67*b* and recording paper P and greater than the force of friction between respective sheets of recording paper P, P. For this reason, even if multiple sheets of recording paper P, P, . . . are taken up from automatic-feed cassette 61 and are fed to paper separator mechanism 67, separator roller 67*a* will be able to separate these multiple sheets of recording paper P, P, . . . and feed only the topmost sheet of recording paper P to transport path(s).

Pulleys 67*c*, 66*a* are respectively provided on the shafts of the aforementioned separator roller 67*a* and takeup roller 66, belt 68 spanning these pulleys 67*c*, 66*a*. In addition, drive force from a drive motor, not shown, is transmitted to separator roller 67*a*, and the motor drive force transmitted to this separator roller 67*a* is transmitted to takeup roller 66 by way of belt 68. Furthermore, the shafts of this separator roller 67*a* and this takeup roller 66 are supported by the same support plate (depiction of which is omitted in FIG. 3); and in accompaniment to transmission of drive force from the aforementioned motor to separator roller 67*a*, this support plate pivots (rotating in counterclockwise fashion as viewed in FIG. 3) about the shaft of separator roller 67*a*, causing takeup roller 66 to press against the top surface of recording paper P within automatic-feed cassette 61 (the situation existing following conclusion of such pivoting being shown in FIG. 3). In other words, the constitution is such that in accompaniment to driving of the aforementioned motor, takeup roller 66 presses against recording paper P within automatic-feed cassette 61 and takes up recording paper P from this automatic-feed cassette 61; and separation of recording paper P being carried out by paper separator mechanism 67, only one sheet of recording paper P is fed from automatic-feed cassette 61 to the paper transport path.

Description of Manual-Feed Mechanism Unit 7

As shown in FIGS. 2 and 3, manual-feed mechanism unit 7 is provided with the aforementioned manual-feed tray 71 which is capable of being pulled outward from the aforementioned module casing 52 and toward the side (the right side at FIG. 1) of hybrid device 1. As shown in FIG. 3, this manual-feed tray 71 is equipped with tray base 72, which is supported so as to permit movement in parallel fashion with respect to groove 52*a* formed in module casing 52; and manual-feed tray main body 73, which is supported so as to permit it to pivot relative to this tray base 72 by means of pivot shaft(s) extending horizontally.

Moreover, this manual-feed tray main body 73 is equipped with first tray 74, which is supported so as to permit it to pivot relative to tray base 72 by means of pivot shaft(s) extending horizontally; and second tray 75, which is supported so as to permit it to pivot relative to the tip (the top end when in its stored state as shown in FIG. 3) of this first tray 74.

Figure 4:
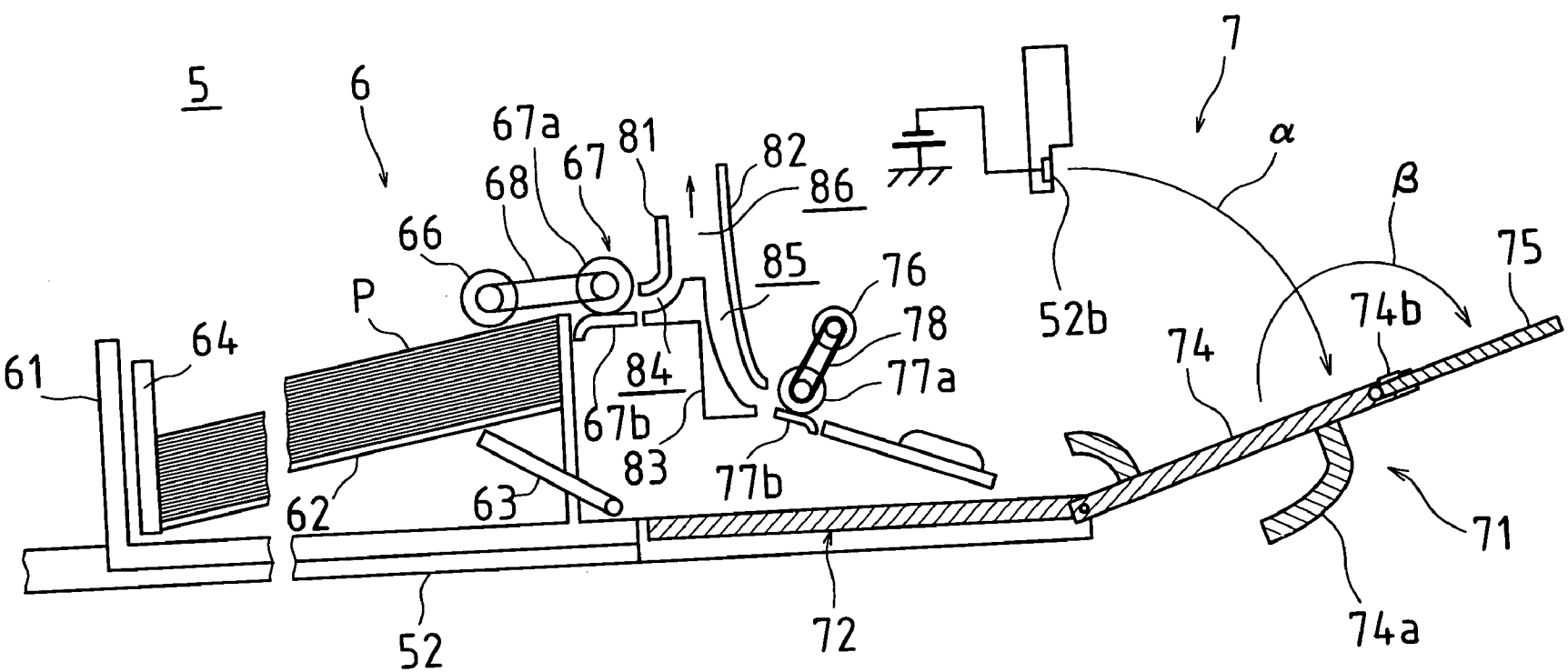
FIG. 4 is a drawing corresponding to FIG. 3 and showing a manual-feed tray in an opened state.

This being the case, in the event that paper is to be supplied from the present manual-feed mechanism unit 7, first tray 74 is made to pivot toward one side of the apparatus relative to tray base 72, and furthermore, second tray 75 is made to pivot toward one side of the apparatus relative to first tray 74. As a result, as shown in FIG. 4, the respective inside surfaces of first tray 74 and second tray 75 are made to lie in a single plane and face upward, permitting placement (manual loading) of recording paper P thereon over a region extending from first tray 74 to second tray 75. Moreover, the aforementioned first tray 74 is provided with grip region 74*a*, serving as deployment grip region, which is located on the side of the outside surface of the apparatus when first tray 74 is in its stored state as shown in FIG. 3, and by grabbing this grip region 74*a* and causing first tray 74 to swing downward and to the side of the apparatus, a user can cause this first tray 74 to assume its opened state.

This grip region 74*a* is formed by a small projection formed in the central region of the outside surface of first tray 74, and by grabbing this grip region 74*a* with his or her finger and pivoting first tray 74 downward, a user can cause deployment (pivoting) of only first tray 74 without causing sliding motion of manual-feed mechanism unit 7 (see arrow α in FIG. 4).

Furthermore, the aforementioned manual-feed tray 71 is provided with a pair of guide members 79, 79 (not shown in FIG. 2) constraining placement location(s) of recording paper P placed therein or thereon by abutting against respective edges of recording paper P in the width direction (i.e., the edges extending in the direction of transport of the recording paper P placed therein or thereon), these guide members 79, 79 being supported so as to permit movement in sliding fashion in or on manual-feed tray 71. At this manual-feed tray 71 as well, placement of recording paper P is such that it is centered in the paper width direction. For this reason, respective guide members 79, 79 are supported by a sliding mechanism, not shown, causing them to slide so as to mutually approach or recede in synchronous fashion.

Furthermore, manual-feed mechanism unit 7 of the present embodiment is such that it permits operations for opening of first tray 74 to be carried out automatically. More specifically, small metal piece 74*b* is attached to the tip region of the inside surface of first tray 74 (i.e., the top surface when in its opened state as shown in FIG. 4), and electromagnet 52*b* is provided at a location which is on the side surface of module casing 52 or the hybrid device main body and which opposes the aforementioned metal piece 74*b* when first tray 74 is in its stored state. A DC power supply is connected to this electromagnet 52*b*, the electromagnetic being energized when electricity flows therethrough, electromagnetic attraction for the aforementioned metal piece 74*b* causing first tray 74 to be maintained in its stored state. Furthermore, when the user operates a control panel of hybrid device 1 or there is otherwise a request for supply of paper from manual-feed mechanism unit 7, electromagnet 52*b* is deenergized, terminating the electromagnetic attraction thereof for the aforementioned metal piece 74*b* and causing first tray 74 to pivot under its own weight so as to cause it to go from its stored state to its opened state.

Furthermore, formed at the bottom end of the aforementioned manual-feed tray 71 is second grip region 71*a* serving as opening grip region. This grip region 71*a* is formed by a concave region which is such that the concavity is thereabove when first tray 74 is in its closed state as shown in FIG. 3, and by inserting his or her finger in this grip region 71*a* and pulling outward and to the side of the apparatus (toward the right in FIG. 3), a user can cause the entirety of manual-feed mechanism unit 7 to be pulled outward, opening up the interior of hybrid paper supply module 5 to the exterior (see FIG. 5). More specifically, this second grip region 71*a* comprises a small projection provided at the bottom end of the inside surface of first tray 74, a space for insertion of the user's finger being formed between first tray 74 and second grip region 71*a*. In addition, by inserting his or her finger in this insertion space and pulling first tray 74 to one side of the apparatus, a user can cause the entirety of manual-feed mechanism unit 7 to be pulled outward (moving it in sliding fashion), opening up the interior of hybrid paper supply module 5 to the exterior. Note that this opened state is described below.

Respectively provided at the paper discharge side of the present manual-feed mechanism unit 7 are paper separator mechanism 77 and paper pickup roller(s) 76 constituting a paper takeup mechanism.

The aforementioned paper separator mechanism 77 is equipped with separator roller(s) 77*a* and separator plate(s) 77*b*. As the constitution of these is similar to that at the aforementioned paper separator mechanism 67 provided at automatic-feed cassette mechanism unit 6, description is omitted here.

In addition, pulleys 77*c*, 76*a* are respectively provided on the shafts of the aforementioned separator roller 77*a* and paper pickup roller 76, belt 78 spanning these pulleys 77*c*, 76*a*. In addition, drive force from a drive motor, not shown, is transmitted to separator roller 77*a*, and the motor drive force transmitted to this separator roller 77*a* is transmitted to paper pickup roller 76 by way of belt 78. Furthermore, the shafts of this separator roller 77*a* and this paper pickup roller 76 are supported by the same support plate (not shown); and in accompaniment to transmission of drive force from the aforementioned motor to separator roller 77*a*, this support plate pivots about the shaft of separator roller 77*a*, causing paper pickup roller 76 to press against the top surface of recording paper P lying on manual-feed tray 71. In other words, the constitution is such that in accompaniment to driving of the aforementioned motor, paper pickup roller 76 presses against recording paper P lying on manual-feed tray 71 and takes up recording paper P from this manual-feed tray 71; and separation of recording paper P being carried out by paper separator mechanism 77, only one sheet of recording paper P is fed from manual-feed tray 71 to the paper transport path.

Paper Supply Path

Next, the paper supply path (the path internal to hybrid paper supply module 5) for transporting toward main transport path 36 recording paper P that has been taken up by automatic-feed cassette mechanism unit 6 or manual-feed mechanism unit 7, having constitutions as described above, will be described.

This paper supply path is made up of first through third guide members 81, 82, 83. First guide member 81 is made up of a plate which is curved so as to be directed vertically upward from a point immediately downstream from separator roller 67*a* of the aforementioned automatic-feed cassette mechanism unit 6. Furthermore, second guide member 82 is made up of a plate which is curved so as to be directed vertically upward from a point immediately downstream from separator roller 77*a* of the aforementioned manual-feed mechanism unit 7. Moreover, third guide member 83, located between the aforementioned first guide member 81 and second guide member 82, is provided with first curved surface 83*a*, which opposes the lower portion of first guide member 81; and second curved surface 83*b*, which opposes the lower portion of second guide member 82.

As a result of the foregoing constitution, first path 84, by means of which the direction of transport of recording paper P taken up from automatic-feed cassette mechanism unit 6 is directed upward, is formed between first guide member 81 and first curved surface 83*a* of third guide member 83; and furthermore, second path 85, by means of which the direction of transport of recording paper P taken up from manual-feed mechanism unit 7 is directed upward, is formed between second guide member 82 and second curved surface 83*b* of third guide member 83. In addition, common path 86, extending vertically upward, is formed between the aforementioned first guide member 81 and second guide member 82; the aforementioned first path 84 and second path 85 being such that the downstream ends thereof are mutually connected and intersect at common path 86. That is, recording paper P, whether taken up from automatic-feed cassette mechanism unit 6 or manual-feed mechanism unit 7, after passing through the aforementioned common path 86 provided at the interior of hybrid paper supply module 5, is introduced into main transport path 36 and arrives at printing unit 3, where prescribed image forming operation take place. Accordingly, there is only one path (main transport path 36) by which recording paper P is discharged in going toward printing unit 3 from hybrid paper supply module 5, eliminating the need to have two paths at the hybrid device 1 main body such as would be the case were there one path for the automatic-feed cassette and another path for the manual-feed tray. This being the case, not only is it possible to shorten the length of the overall transport path of hybrid device 1 and achieve simplification of the constitution at the interior of hybrid device 1, but it is also possible to reduce the number of locations at which paper jams can occur, and it is possible to reduce the frequency of occurrence of paper jams.

Figure 5:
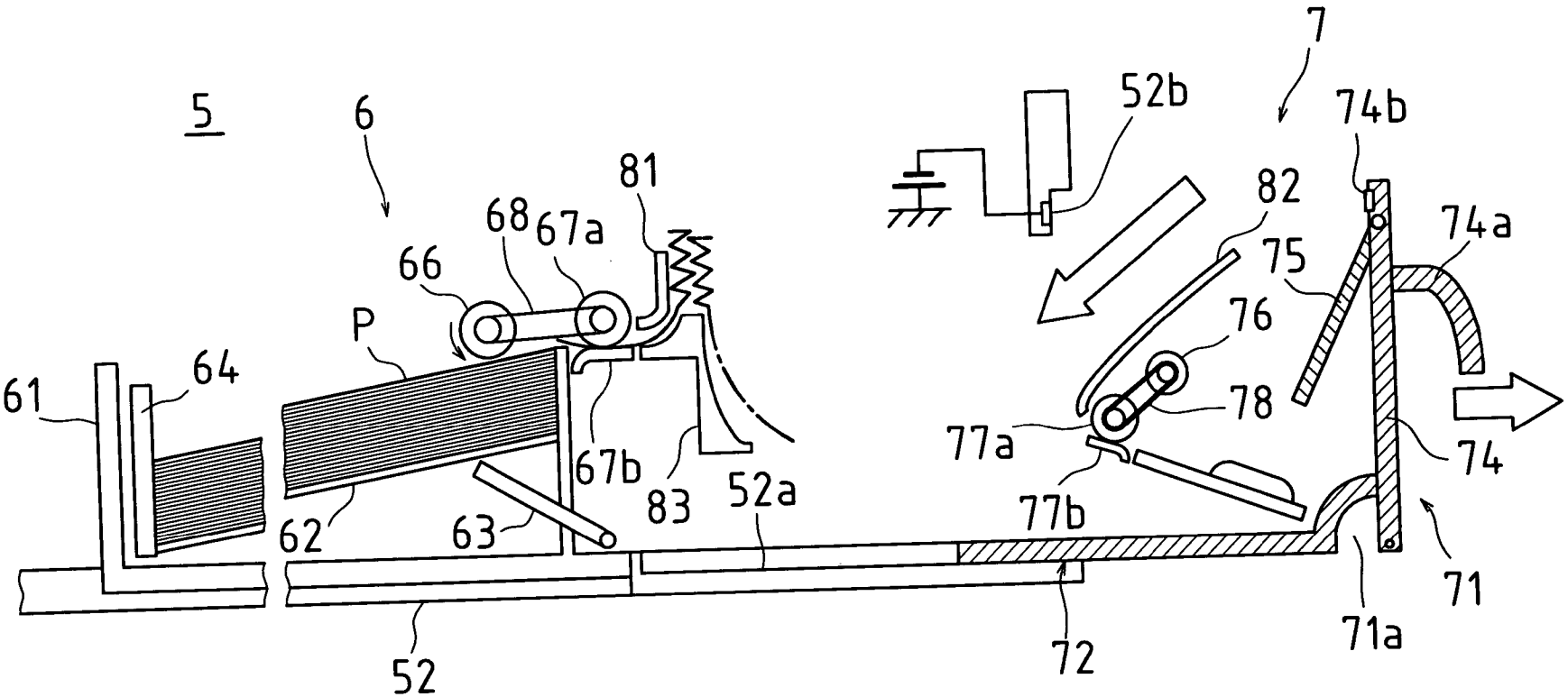
FIG. 5 is a drawing corresponding to FIG. 3 and showing a manual-feed mechanism unit that has been pulled outward at a time when a paper jam has occurred.

Furthermore, whereas the aforementioned first guide member 81 and third guide member 83 are supported by the aforementioned module casing 52, second guide member 82 is provided in such fashion that it is integral with the aforementioned manual-feed mechanism unit 7. In other words, when manual-feed mechanism unit 7 is pulled outward as indicated at FIG. 5, this second guide member 82 is pulled away from module casing 52 together with manual-feed mechanism unit 7. This being the case, access is opened up to common path 86 constituted by the space between same and first guide member 81, and to second path 85 constituted by the space between same and third guide member 83; making it possible to easily carry out procedure(s) for removal of paper in the event of occurrence of paper jam(s) at such paths. Of the recording paper P involved in jams in FIG. 5, that shown with a solid line indicates jamming of recording paper P transported thereto from automatic-feed cassette mechanism unit 6, and that shown with an alternating long and short chain line indicates jamming of recording paper P transported thereto from manual-feed mechanism unit 7.

Furthermore, the aforementioned second guide member 82 is provided with a pivot mechanism, not shown, such that second guide member 82 extends vertically so as to form the aforementioned respective paths when, as shown in FIGS. 3 and 4, manual-feed mechanism unit 7 is not pulled outward therefrom; but such that second guide member 82 leans toward manual-feed tray 71, thus enlarging the space within which the user can insert his or her hand during removal of jammed paper (the direction in which the user's hand is inserted being indicated by an arrow at FIG. 5), when, as shown in FIG. 5, manual-feed mechanism unit 7 is pulled outward therefrom.

Paper Feed Operations

Figure 6:
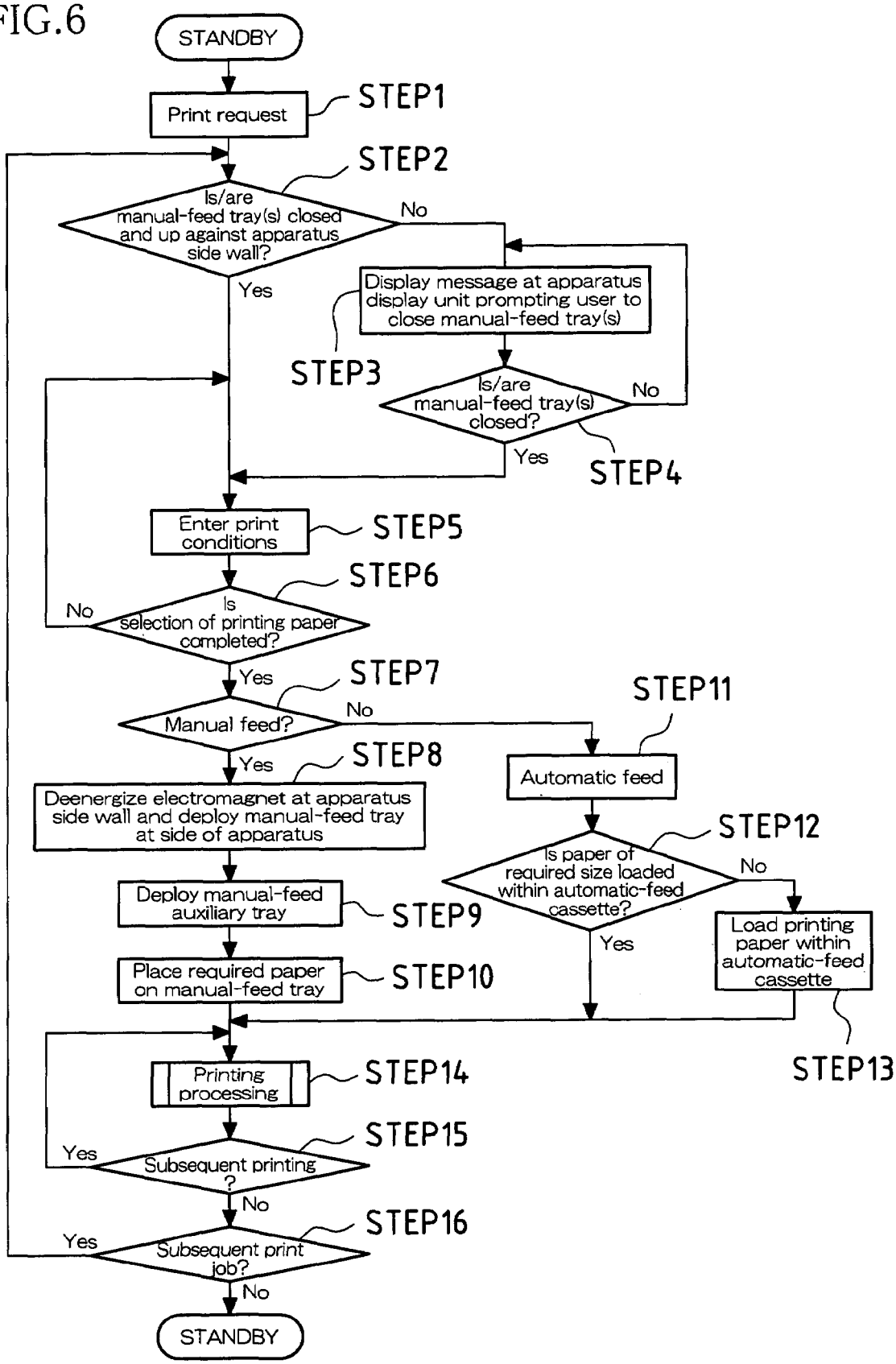
FIG. 6 is a flowchart for explaining paper feed operations carried out by a hybrid paper supply module.

Following the flowchart of FIG. 6, paper feed operations carried out by hybrid paper supply module 5 having the foregoing constitution will next be described.

First, if at STEP 1 the user operates a control panel of hybrid device 1 (or operates a host device connected thereto) or there is otherwise a request to carry out printing, then at STEP2 determination is made as to whether manual-feed tray 71 of manual-feed mechanism unit 7 is in its stored state; i.e., whether manual-feed mechanism unit 7 is closed off by the side wall of hybrid paper supply module 5. If manual-feed tray 71 is not in its stored state, i.e., if manual-feed tray 71 is in an opened state, then processing proceeds to STEP3, at which notice is given at a display unit (display panel) of the apparatus that manual-feed tray 71 should be put into its stored state (i.e., that manual-feed mechanism unit 7 should be closed). Furthermore, if at STEP4 it is detected that manual-feed tray 71 has been stored (manual-feed mechanism unit 7 has been closed), then processing proceeds to STEP5.

The user enters print conditions (STEP5); and upon selection of printing paper (i.e., the type of recording paper P to be used for image formation), the value at STEP6 goes to YES, and processing proceeds to STEP7. Here, determination is carried out as to whether the selected print conditions are such that the paper supply source is manual-feed mechanism unit 7. If this is determined to be YES, then processing proceeds to STEP8, at which the aforementioned electromagnet 52*b* is turned OFF, opening manual-feed tray 71 of manual-feed mechanism unit 7 (i.e., manual-feed tray 71 swings down from the side of hybrid paper supply module 5: arrow α in FIG. 4). Furthermore, after, where necessary, carrying out (at STEP9) a procedure (arrow β in FIG. 4) in which second tray 75 serving as auxiliary tray is made to pivot (i.e., is opened), recording paper P is placed on manual-feed tray 71 (STEP10), and processing proceeds to STEP14.

Conversely, if the answer as determined at STEP7 is NO, then it is determined (STEP11) that the paper supply source pursuant to the selected print conditions is automatic-feed cassette mechanism unit 6; and at STEP12, determination is carried out as to whether recording paper P of the required size (recording paper P consistent with the foregoing print conditions) is present within automatic-feed cassette 61 of automatic-feed cassette mechanism unit 6. If the result of this determination is YES, then processing proceeds to STEP14; but if the result of this determination is NO, then at STEP13 the user carries out operations for loading of recording paper P consistent with print conditions, following which processing proceeds to STEP14. As examples of this determination as to whether recording paper P consistent with print conditions is loaded therein, paper sensor(s) might be provided at automatic-feed cassette 61, and type(s) (size(s) and/or orientation(s)) of loaded recording paper P might be detected by such sensor(s) and displayed at display panel(s), with determination being carried out pursuant to confirmation of such display by the user; or a warning might be issued to the user in the event that type(s) of recording paper P loaded in automatic-feed cassette 61 as confirmed by hybrid device 1 is/are different from type(s) of recording paper P at the foregoing print conditions, prompting the user to carry out operations for loading of recording paper P consistent with print conditions; and so forth.

Moreover, printing processing is carried out at STEP14; and after paper has been supplied from the desired mechanism unit and image forming has at printing unit 3 been carried out on that recording paper P, operations are carried out for discharge thereof to discharge tray 35.

After printing operations have been carried out on this single sheet of recording paper P, determination is made at STEP15 as to whether there is subsequent printing to be carried out (i.e., whether subsequent print information exists); the operations at STEPS 14 and 15 being carried out in repeated fashion until subsequent print information does not exist.

Moreover, when subsequent print information no longer exists, determination is carried out at STEP16 as to whether subsequent print job(s) exist; and in the event that there is/are subsequent print job(s), processing returns to STEP2; the foregoing operations being carried out in repeated fashion until subsequent print job(s) no longer exist.

Benefits Of First Embodiment

As has been described above, in the present embodiment, automatic-feed cassette mechanism unit 6 and manual-feed mechanism unit 7 together constitute a single integral hybrid paper supply module 5. This being the case, it is possible for manual-feed mechanism unit 7 to be arranged such that it is stacked vertically with respect to main transport path 36 and flipping transport path 37 which extend so as to be directed toward printing unit 3 of hybrid device 1, as a result of which it is possible to shorten dimension(s) of hybrid device 1 and achieve reduction in the amount of space required for installation.

Furthermore, this hybrid paper supply module 5 makes it possible to cause the path along which recording paper P taken up from automatic-feed cassette mechanism unit 6 is transported and the path along which recording paper P taken up from manual-feed mechanism unit 7 is transported to intersect at the interior of module 5, and makes it possible to decrease the lengths of the respective paths. This being the case, the length of the overall paper transport path of the apparatus can be shortened, the number of locations at which paper jams can occur can be reduced, and image forming operations at the apparatus can be carried out in stable fashion.

Other Embodiments

Whereas in the foregoing embodiments the present invention has been described in terms of an example in which it is applied to a multifunction image forming apparatus (hybrid device) 1 combining the functions of copier, printer, and facsimile machine, the present invention is not limited thereto but may also be applied to an image forming apparatus provided with any one function, and to other image forming apparatuses as well.

Furthermore, whereas manual-feed tray 71 of manual-feed mechanism unit 7 was of folding type and permitted adjustment of length in two stages; the present invention is not limited thereto, it being possible for the structure to be of pullout type such that adjustment of length is permitted, and/or it is also possible to adopt a constitution in which length is adjustable in three or more stages.

Below, other embodiments, in which constitution(s) of hybrid device(s) associated therewith is/are different from that associated with the foregoing first embodiment, are described below.

Second Embodiment

The following embodiment of the present invention is described with reference to the drawings. Note at the present second embodiment that there is a hybrid device of constitution identical to that associated with the foregoing first embodiment. This being the case, at the present second embodiment, like components are given like reference numerals and description thereof is omitted.

—Description of Overall Constitution of Hybrid Device—

Figure 7:
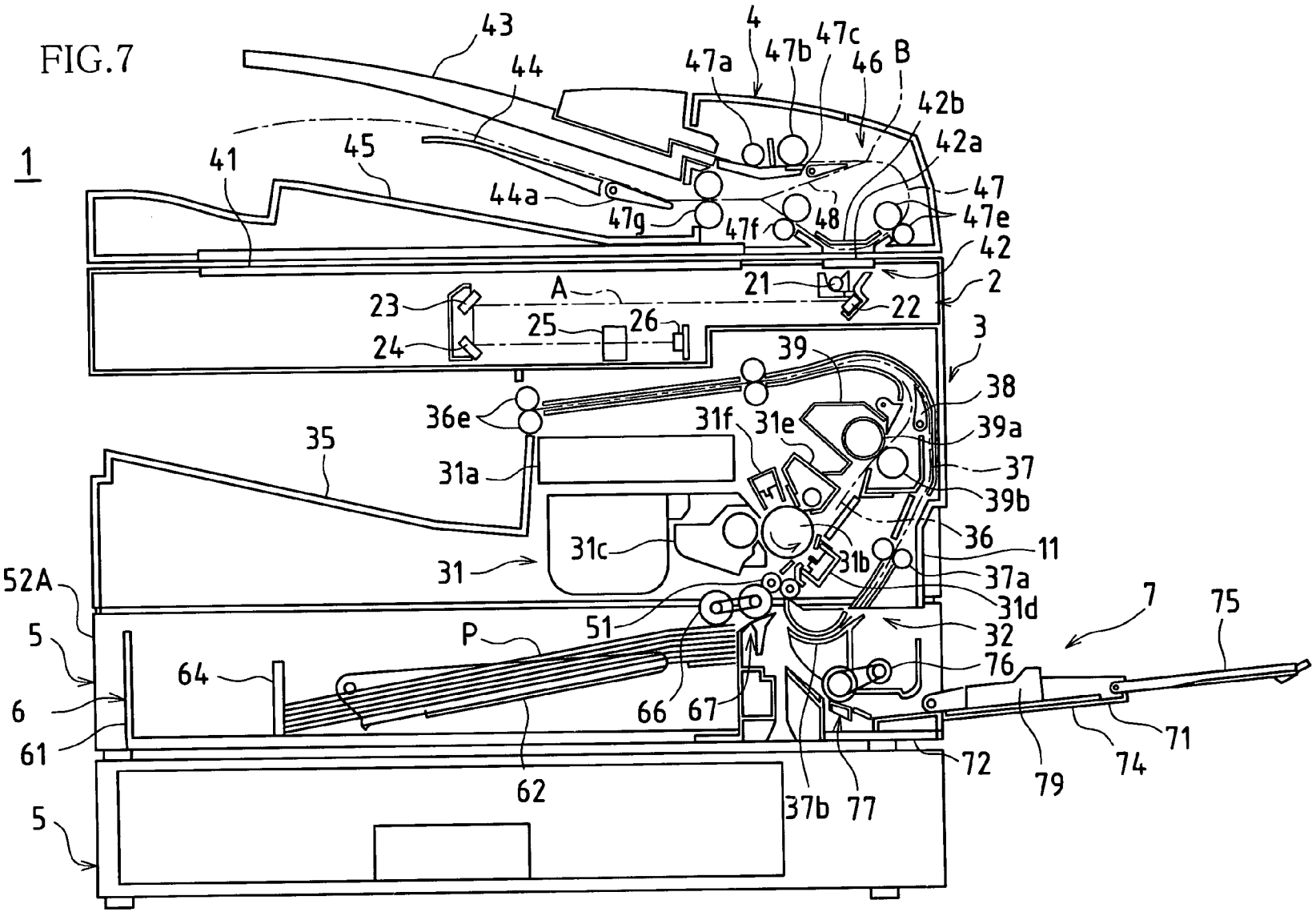
FIG. 7 is a drawing showing in schematic fashion the internal constitution of a hybrid device associated with an embodiment of the present invention.
Figure 8:
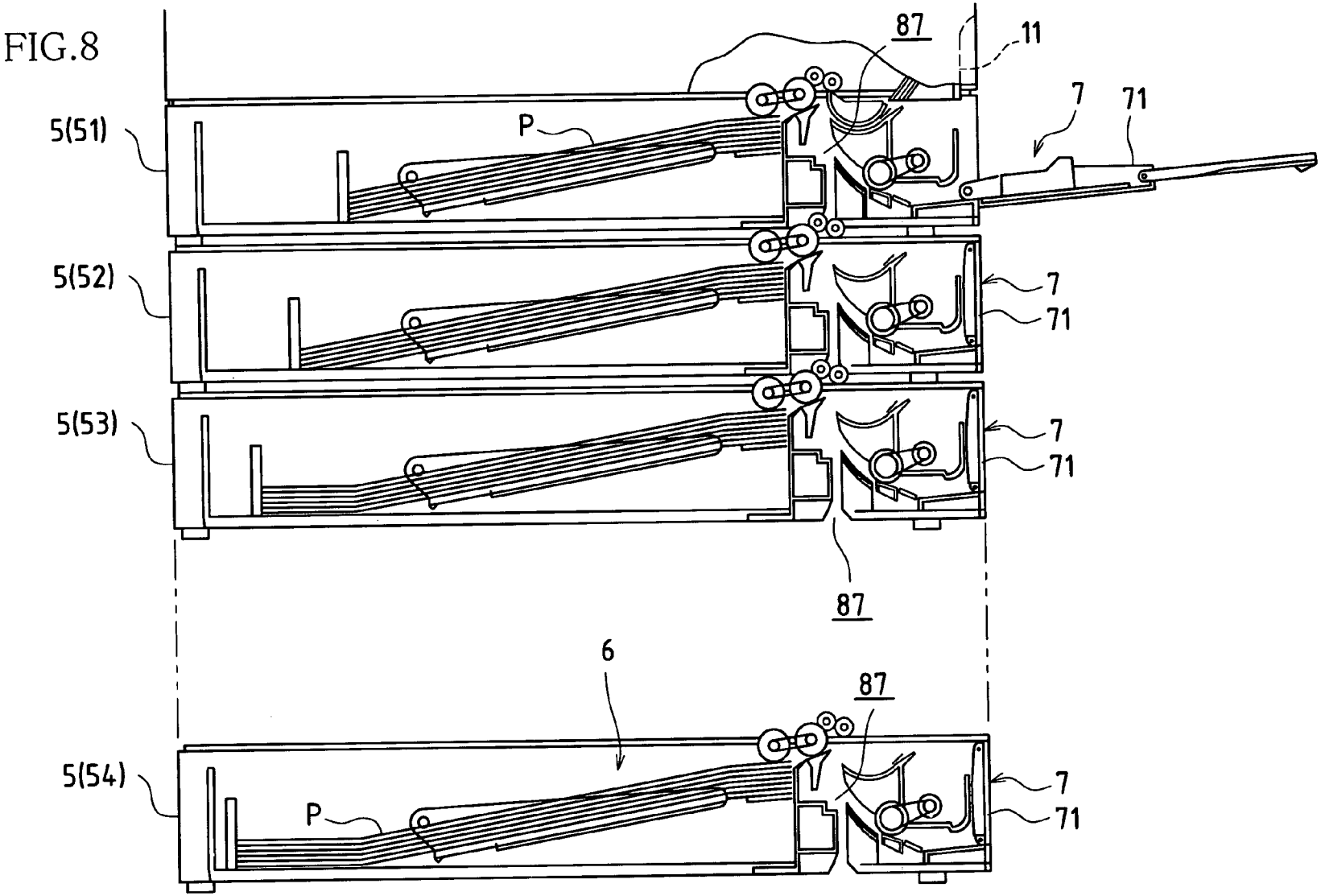
FIG. 8 is a drawing showing in schematic fashion the respective constitutions at the interiors of a plurality of hybrid paper supply modules that have been stacked together.

FIG. 7 shows in schematic fashion the internal constitution of hybrid device 1 which serves as image forming apparatus associated with the present embodiment. Furthermore, FIG. 8 shows in schematic fashion the respective constitutions at the interiors of a plurality of hybrid paper supply modules 5, 5, . . . that have been stacked together, same being characteristic of one or more embodiments of the present invention. As shown in FIG. 7, hybrid device 1 is provided with scanning unit 2, printing unit 3 serving as image forming unit, and automatic original feed unit 4. Description of the respective units follows below.

Description of Scanning Unit 2

Scanning unit 2 is provided with exposing light source 21; plurality of reflecting mirrors 22, 23, 24; imaging lens 25; and photoelectric conversion element 26.

Description of Printing Unit 3

Printing unit 3 is provided with image forming system 31 and paper transport system 32.

Paper transport system 32 transports recording paper P one sheet at a time from either automatic-feed cassette mechanism unit 6 or manual-feed mechanism unit 7 provided at each of a plurality of hybrid paper supply modules 5, 5, . . . , described below, so as to permit image formation by the aforementioned image forming system 31, and also discharges recording paper P to discharge tray 35 serving as paper discharge unit after image(s) have been formed thereon.

This paper transport system 32 is provided with main transport path 36 and flipping transport path 37. One end of main transport path 36 opposes the discharge side of topmost-stacked hybrid paper supply module 5, and the other end thereof opposes discharge tray 35. One end of flipping transport path 37 is connected to main transport path 36 at a point upstream from (below, in the drawing) the location at which transfer unit 31*d* is installed, and the other end thereof is connected to main transport path 36 at a point downstream from (above, in the drawing) the location at which transfer unit 31*d* is installed. Moreover, in the present embodiment, a portion of flipping transport path 37 passes through the interior of topmost-stacked hybrid paper supply module 5. For this reason, guide member 37*b*, for forming flipping transport path 37, is provided at the interior of hybrid paper supply module 5.

Description of Automatic Original Feed Unit 4

Automatic original feed unit 4 will next be described. This automatic original feed unit 4 is constructed so as to permit it to serve as "automatic double-sided original transport apparatus." This automatic original feed unit 4 is capable of being used for moving sheet operation, and is provided with original loading unit(s) comprising original tray 43 and intermediate tray 44 and original discharge tray 45 serving as original discharge unit, and original transport system 46 for transporting originals between respective trays 43,44, 45.

—Description of Basic Operation of Hybrid Device—

Among the operations carried out by hybrid device 1 having the foregoing constitution, hybrid device 1—firstly when functioning as a printer—receives print data (image data and/or text data) sent thereto from a personal computer or other such host device, and temporarily stores this received print data in buffer(s) (memory or memories), not shown. Along with such storage of print data to buffer, print data is sequentially read from buffer; and based on the print data read therefrom, image formation is carried out on recording paper P by virtue of image forming operations taking place at the aforementioned printing unit 3.

Furthermore, when functioning as a scanner, hybrid device 1 temporarily stores, in buffer(s), scan image data of original(s) captured by the aforementioned scanning unit 2. Along with such storage of scan image data to buffer, scan image data is sequentially sent from buffer to host apparatus, image(s) thereof being displayed on a display or the like at this host apparatus. Note that when hybrid device 1 functions as a facsimile device, this scan image data would be sent to a regular public line.

Moreover, when functioning as a copier, hybrid device 1 temporarily stores, in buffer(s), image formation is carried out on recording paper P by virtue of image forming operations taking place at printing unit 3 based on original image data captured by means of the foregoing scanner function.

—Description of Hybrid Paper Supply Module 5—

The aforementioned hybrid paper supply module 5, being a characteristic feature of the present embodiment, will next be described. As shown in FIGS. 7 and 8, the present hybrid device 1 is equipped with a paper supply mechanism made up of a plurality of hybrid paper supply modules 5, 5, . . . that have been stacked together. Because respective hybrid paper supply modules 5, 5, . . . are all of substantially identical constitution, description is here carried out in terms of one hybrid paper supply module 5 taken to be representative there among.

Figure 9:
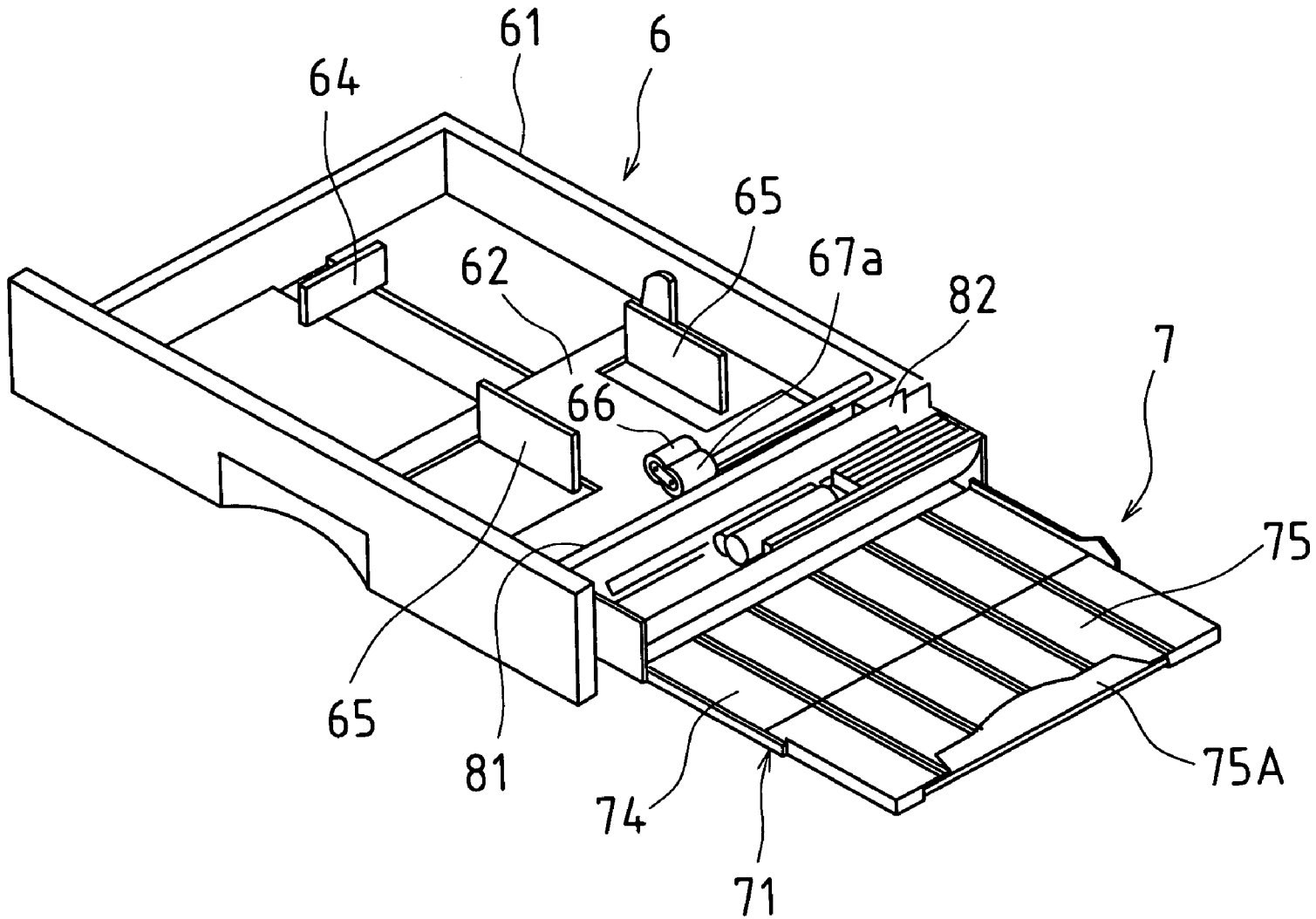
FIG. 9 is an oblique partial cutaway view of a hybrid paper supply module.

FIG. 9 is an oblique partial cutaway view of automatic-feed cassette mechanism unit 6 and manual-feed mechanism unit 7 of hybrid paper supply module 5. Furthermore, FIG. 10 is a drawing showing in schematic fashion a simplified rendering of the constitution at the interior of this hybrid paper supply module 5.

As shown in the respective drawings, hybrid paper supply module 5 is constructed such that the foregoing automatic-feed cassette mechanism unit 6 and manual-feed mechanism unit 7 are contained within module casing 52A, which constitutes the housing of the present module 5. Moreover, whereas automatic-feed cassette mechanism unit 6 is provided with automatic-feed cassette 61 which is capable of storing a multiplicity of sheets (e.g., 500 sheets) of recording paper P, manual-feed mechanism unit 7 is provided with manual-feed tray 71 which is such as to permit one or a small number of sheets of recording paper to be placed therein or thereon in a manual operation carried out by the user. In other words, this automatic-feed cassette 61 and this manual-feed tray 71 are contained within module casing 52A, forming a single module and constituting the present hybrid paper supply module 5. Moreover, the aforementioned module casing 52A is constructed in the shape of a box having base section 52*c*, top section 52*d*, and side sections 52*e* provided at the three sides which do not include the side at which the foregoing manual-feed mechanism unit 7 is installed. Description of the respective mechanism units 6, 7 follows below.

Description of Automatic-Feed Cassette Mechanism Unit 6

Figure 10:
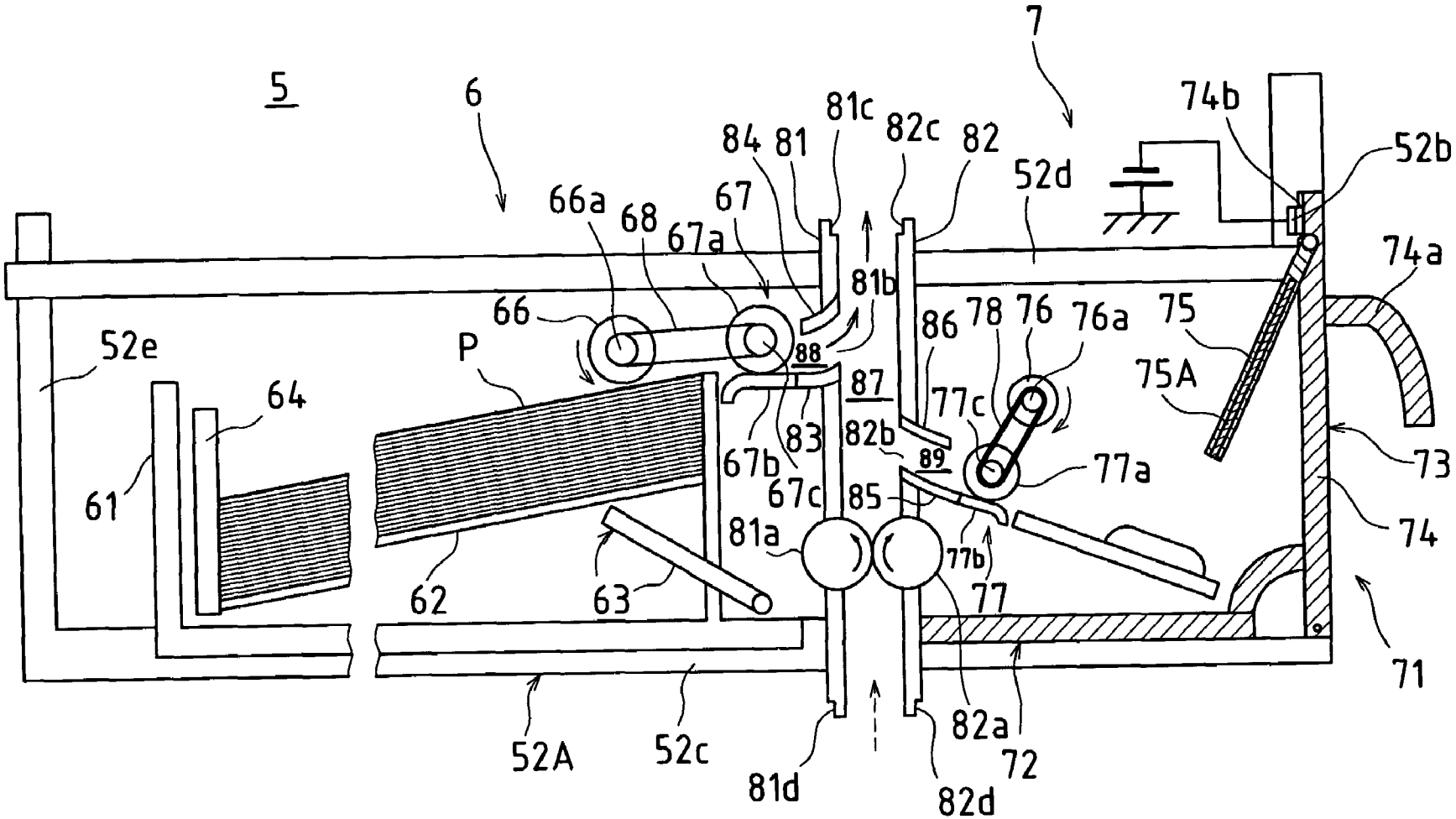
FIG. 10 is a drawing showing in schematic fashion a simplified rendering of the constitution at the interior of a hybrid paper supply module.

As shown in FIGS. 9 and 10, automatic-feed cassette mechanism unit 6 is provided with the aforementioned automatic-feed cassette 61 constructed in the form of a container which is open at the top; and pivotably supported at the interior of this automatic-feed cassette 61 is pivot plate 62, which is made of metal and serves as paper storage plate. In addition, this automatic-feed cassette 61 is capable of being pulled outward from the aforementioned module casing 52A and toward the front side (the near side at FIG. 7) of hybrid device 1, procedures for replenishing this automatic-feed cassette 61 with recording paper being made possible when this automatic-feed cassette 61 has been pulled outward therefrom.

The aforementioned pivot plate 62 is supported so as to permit it to pivot in a vertical direction about a pivot shaft extending in the direction of the width (i.e., perpendicular to the plane of the paper in FIG. 10) of automatic-feed cassette 61, and the bottom thereof is abutted by lift plate 63 which is imparted with an upward torque. In other words, as a result of the restoring force from lift plate 63, this pivot plate 62 is constantly acted upon by an upward restoring force. Note that a coil spring may be provided instead of this lift plate 63, in which case it would be the restoring force from the coil spring that would cause this pivot plate 62 to constantly be acted upon by an upward restoring force.

Furthermore, provided at one end (the right end in FIG. 10) within automatic-feed cassette 61 are paper lead edge alignment tabs, not shown, for pressing against the lead edge of recording paper P and aligning this recording paper P, and the corners of the lead edge of recording paper P are pressed downward from above by these paper lead edge alignment tabs. For this reason, when recording paper P is loaded within automatic-feed cassette 61, pivot plate 62 pivots upward due to the restoring force from lift plate 63, the rotational position thereof being constrained at the position at which the corners of the lead edge of recording paper P abut the paper lead edge alignment tabs. With automatic-feed cassette 61 in this state it is pushed into module casing 52A; and as a result, a multiplicity of sheets of recording paper are loaded into automatic-feed cassette mechanism unit 6.

Furthermore, paper trail edge guide member 64, which positions the trail edge of recording paper P in the feed direction, is fixed to the interior of the aforementioned automatic-feed cassette 61. Furthermore, paper side edge guide members 65, 65, for positioning the two edges of recording paper P at sides perpendicular to the feed direction, are also fixed thereto. Note that hybrid paper supply module 5 associated with the present embodiment stores recording paper P such that it is centered in the paper width direction. This being the case, respective paper side edge guide members 65, 65 are respectively attached at locations mutually equidistant from the center in the width direction (i.e., direction perpendicular to the plane of the paper in FIG. 10) of automatic-feed cassette 61. The magnitude of the gap between these equidistant locations is determined by the size of recording paper P to be contained therewithin.

Respectively provided at the paper discharge side of automatic-feed cassette mechanism unit 6 are paper separator mechanism 67 and takeup roller(s) 66 constituting a paper takeup mechanism.

The aforementioned paper separator mechanism 67 is equipped with separator roller(s) 67*a* and separator plate(s) 67*b*. Separator plate 67*b* is such that the force of friction between the top surface thereof (the surface coming in contact with recording paper P) and recording paper P is set so as to be greater than the force of friction between sheets of recording paper P, P. Furthermore, at separator roller 67*a*, the force of friction between this separator roller 67*a* and recording paper P is set so as to be greater than the force of friction between the top surface of separator plate 67*b* and recording paper P and greater than the force of friction between respective sheets of recording paper P, P. For this reason, even if multiple sheets of recording paper P, P, . . . are taken up from automatic-feed cassette 61 and are fed to paper separator mechanism 67, separator roller 67*a* will be able to separate these multiple sheets of recording paper P, P, . . . and feed only the topmost sheet of recording paper P to paper supply path(s), described below.

Pulleys 67*c*, 66*a* are respectively provided on the shafts of the aforementioned separator roller 67*a* and takeup roller 66, belt 68 spanning these pulleys 67*c*, 66*a*. In addition, drive force from a drive motor, not shown, is transmitted to separator roller 67*a*, and the motor drive force transmitted to this separator roller 67*a* is transmitted to takeup roller 66 by way of belt 68. Furthermore, the shafts of this separator roller 67*a* and this takeup roller 66 are supported by the same support plate (depiction of which is omitted in FIG. 10); and in accompaniment to transmission of drive force from the aforementioned motor to separator roller 67*a*, this support plate pivots (rotating in counterclockwise fashion as viewed in FIG. 10) about the shaft of separator roller 67*a*, causing takeup roller 66 to press against the top surface of recording paper P within automatic-feed cassette 61 (the situation existing following conclusion of such pivoting being shown in FIG. 10). In other words, the constitution is such that in accompaniment to driving of the aforementioned motor, takeup roller 66 presses against recording paper P within automatic-feed cassette 61 and takes up recording paper P from this automatic-feed cassette 61; and separation of recording paper P being carried out by paper separator mechanism 67, only one sheet of recording paper P is fed from automatic-feed cassette 61 to the paper supply path.

Description of Manual-Feed Mechanism Unit 7

As shown in FIGS. 9 and 10, manual-feed mechanism unit 7 is equipped with the aforementioned manual-feed tray 71. As shown in FIG. 10, this manual-feed tray 71 is equipped with tray base 72, which is supported by module casing 52A; and manual-feed tray main body 73, which is supported so as to permit it to pivot relative to this tray base 72 by means of pivot shaft(s) extending horizontally.

Moreover, this manual-feed tray main body 73 is equipped with first tray 74, which is supported so as to permit it to pivot relative to tray base 72 by means of pivot shaft(s) extending horizontally; second tray 75, which is supported so as to permit it to pivot relative to the tip (the top end when in its stored state as shown in FIG. 10) of this first tray 74; and third tray 75A, which is contained within second tray 75 and which is capable of being pulled out from this second tray 75. That is, this manual-feed tray 71 is constituted such that it can be collapsed in such fashion as to decrease its total length and permit it to be stored at the side of module casing 52A when not in use, and such that it can be deployed in such fashion as to permit its total length to be varied when in use.

Figure 11:
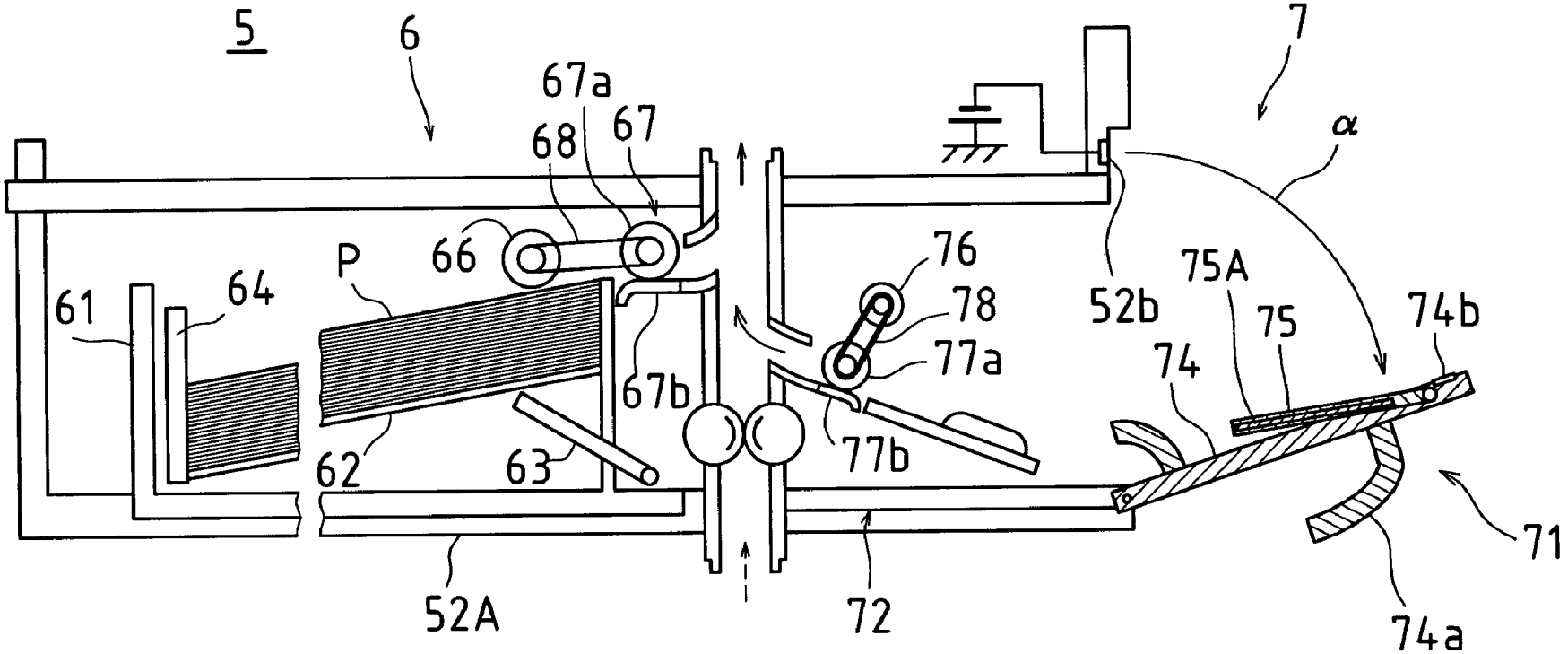
FIG. 11 is a drawing corresponding to FIG. 10 and showing a situation in which a first tray has been made to pivot toward one side of the apparatus.

As a result, in the event that paper is to be supplied from the present manual-feed mechanism unit 7, firstly taking the case in which recording paper P is of relatively small size (e.g., B5-size paper), first tray 74 is made to pivot (see arrow α in FIG. 11) toward one side of the apparatus relative to tray base 72. As a result, as shown in FIG. 11, the inside surface of first tray 74 is made to face upward, permitting placement (manual loading) of recording paper P on this first tray 74. Furthermore, in accompaniment to this operation, manual-feed path 89, which is described below and which is the recording medium transport path of manual-feed mechanism unit 7, is opened up to the exterior (i.e., assumes a state permitting introduction of recording paper P thereinto).

Figure 12:
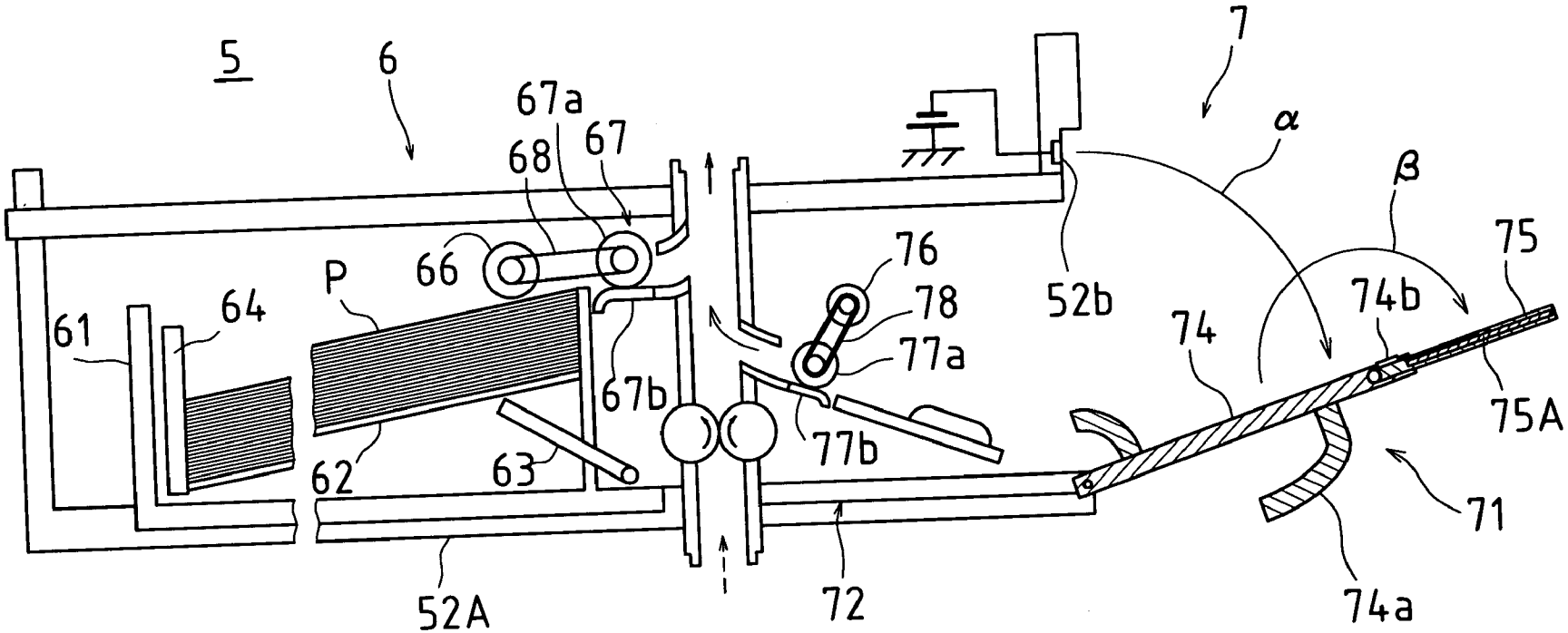
FIG. 12 is a drawing corresponding to FIG. 10 and showing a situation in which a first tray and a second tray have been made to pivot toward one side of the apparatus.

Furthermore, in the event that recording paper P is of slightly larger size (e.g., A4-size paper), first tray 74 is made to pivot toward one side of the apparatus relative to tray base 72, and furthermore, second tray 75 is made to pivot toward one side of the apparatus relative to first tray 74 (see arrows α and β in FIG. 12). As a result, as shown in FIG. 12, the respective inside surfaces of first tray 74 and second tray 75 are made to lie in a single plane and face upward, permitting placement (manual loading) of recording paper P thereon over a region extending from first tray 74 to second tray 75.

Figure 13:
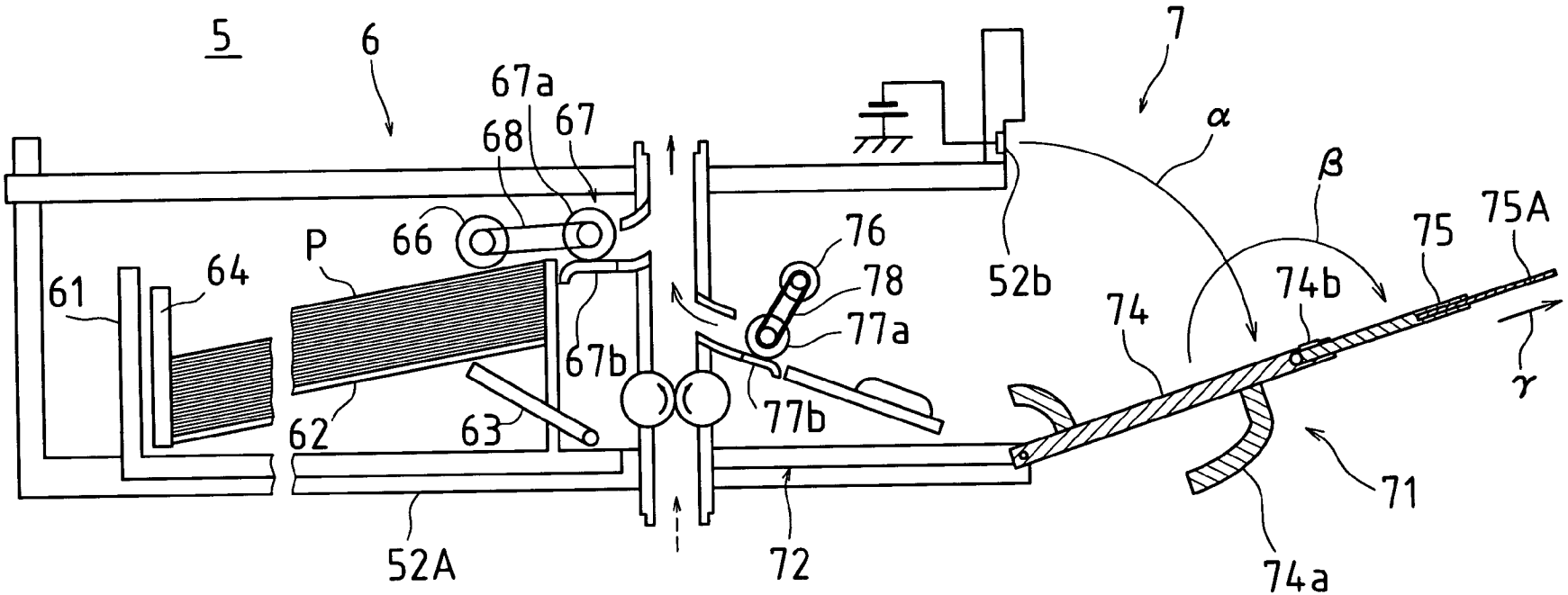
FIG. 13 is a drawing corresponding to FIG. 10 and showing a situation in which a first tray and a second tray have been made to pivot toward one side of the apparatus, and a third tray has been pulled out from the second tray.
Figure 14:
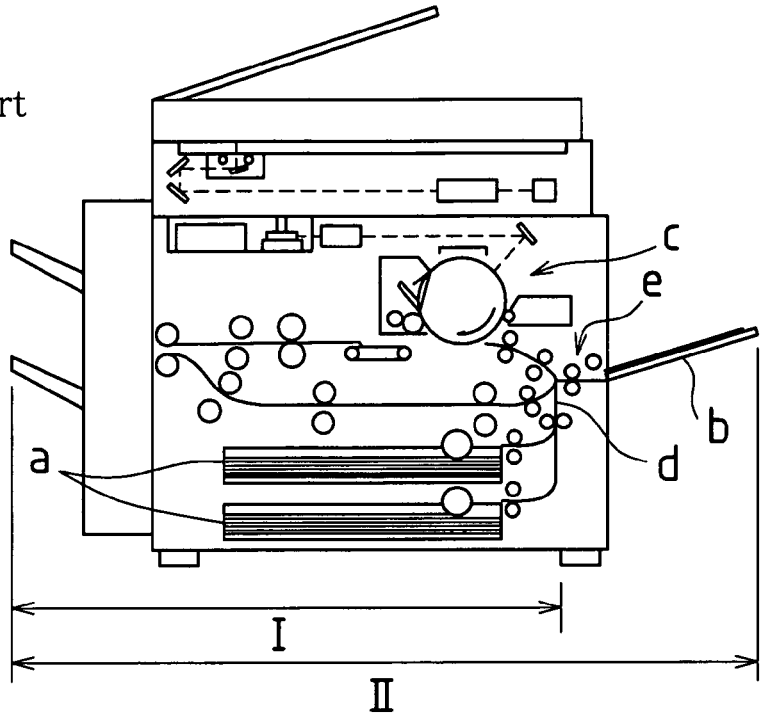
FIG.14 Prior Art
FIG. 14 is a drawing showing in schematic fashion the internal constitution of a typical conventional copier.
Figure 15:
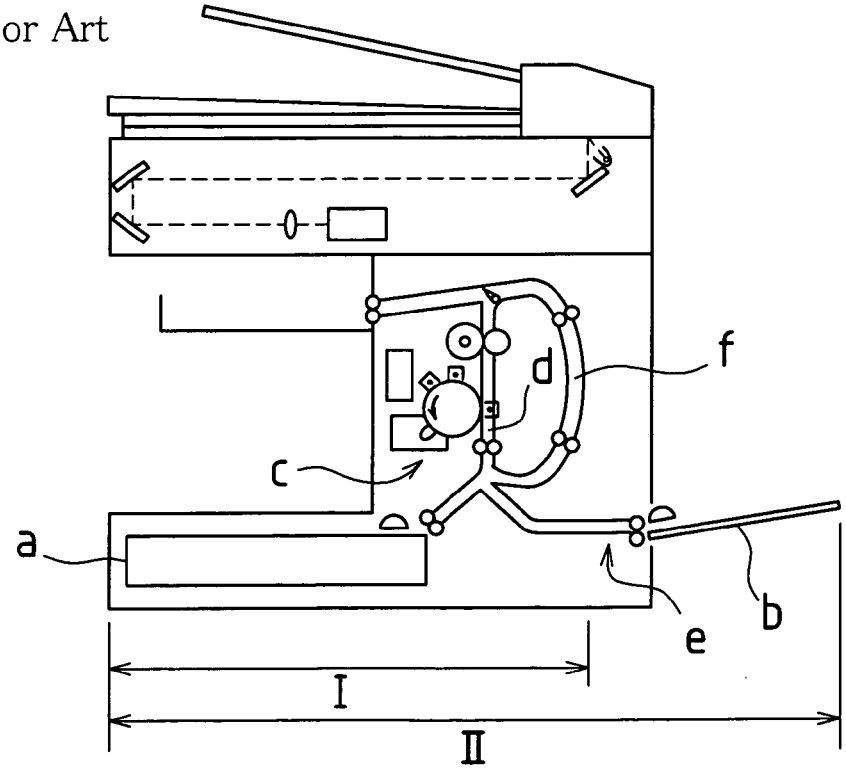
FIG.15 Prior Art
FIG. 15 is a drawing showing in schematic fashion the internal constitution of another conventional copier.

In the event that recording paper P is of still larger size (e.g., A3-size paper), first tray 74 is made to pivot toward one side of the apparatus relative to tray base 72, second tray 75 is made to pivot toward one side of the apparatus relative to first tray 74, and third tray 75A is pulled out from second tray 75 (see arrows α, β, and γ in FIG. 13). As a result, as shown in FIG. 13, the region extending from first tray 74 to third tray 75A is made to lie in a single plane and face upward, permitting placement (manual loading) of recording paper P on these trays 74, 75, 75A.

Moreover, the aforementioned first tray 74 is provided with deployment grip region 74*a* which is located on the side of the outside surface of the apparatus when first tray 74 is in its stored state as shown in FIG. 10, and by grabbing this grip region 74*a* and causing first tray 74 to swing downward and to the side of the apparatus, a user can cause this first tray 74 to assume its opened (deployed) state.

This grip region 74*a* is formed by a small projection formed in the central region of the outside surface of first tray 74, and by grabbing this grip region 74*a* with his or her finger and pivoting first tray 74 downward, a user can cause deployment (pivoting) of only first tray 74 (see arrow α in FIG. 11).

Furthermore, the aforementioned manual-feed tray 71 is provided with a pair of guide members 79, 79 (not shown in FIG. 9) constraining placement location(s) of recording paper P placed therein or thereon by abutting against respective edges of recording paper P in the width direction (i.e., the edges extending in the direction of transport of the recording paper P placed therein or thereon), these guide members 79, 79 being supported so as to permit movement in sliding fashion in or on manual-feed tray 71. At this manual-feed tray 71 as well, placement of recording paper P is such that it is centered in the paper width direction. For this reason, respective guide members 79, 79 are supported by a sliding mechanism, not shown, causing them to slide so as to mutually approach or recede in synchronous fashion. Moreover, these respective guide members 79, 79 may be fixed to manual-feed tray 71. That is, each manual-feed tray 71 may be constituted such that it is capable of accepting placement therein or thereon of a single, fixed size of recording paper P.

Furthermore, manual-feed mechanism unit 7 of the present embodiment is provided with automatic deployment mechanism(s) in order to allow operations for opening of first tray(s) 74 to be carried out automatically. More specifically, small metal piece 74*b* is attached to the tip region of the inside surface of first tray 74 (i.e., the top surface when in its opened state as shown in FIG. 11), and electromagnet 52*b* is provided at a location which is on the side surface of module casing 52A or the hybrid device main body and which opposes the aforementioned metal piece 74*b* when first tray 74 is in its stored state. A DC power supply is connected to this electromagnet 52*b*, the electromagnetic being energized when electricity flows therethrough, electromagnetic attraction for the aforementioned metal piece 74*b* causing first tray 74 to be maintained in its stored state. Furthermore, when the user operates a control panel of hybrid device 1 or there is otherwise a request for supply of paper from manual-feed mechanism unit 7, electromagnet 52*b* is deenergized, terminating the electromagnetic attraction thereof for the aforementioned metal piece 74*b* and causing first tray 74 to pivot under its own weight so as to cause it to go from its stored state to its opened state.

Respectively provided at the paper discharge side of the present manual-feed mechanism unit 7 are paper separator mechanism 77 and paper pickup roller(s) 76 constituting a paper takeup mechanism.

The aforementioned paper separator mechanism 77 is equipped with separator roller(s) 77*a* and separator plate(s) 77*b*. As the constitution of these is similar to that at the aforementioned paper separator mechanism 67 provided at automatic-feed cassette mechanism unit 6, description is omitted here.

In addition, pulleys 77*c*, 76*a* are respectively provided on the shafts of the aforementioned separator roller 77*a* and paper pickup roller 76, belt 78 spanning these pulleys 77*c*, 76*a*. In addition, drive force from a drive motor, not shown, is transmitted to separator roller 77*a*, and the motor drive force transmitted to this separator roller 77*a* is transmitted to paper pickup roller 76 by way of belt 78. Furthermore, the shafts of this separator roller 77*a* and this paper pickup roller 76 are supported by the same support plate (not shown); and in accompaniment to transmission of drive force from the aforementioned motor to separator roller 77*a*, this support plate pivots about the shaft of separator roller 77*a*, causing paper pickup roller 76 to press against the top surface of recording paper P lying on manual-feed tray 71. In other words, the constitution is such that in accompaniment to driving of the aforementioned motor, paper pickup roller 76 presses against recording paper P lying on manual-feed tray 71 and takes up recording paper P from this manual-feed tray 71; and separation of recording paper P being carried out by paper separator mechanism 77, only one sheet of recording paper P is fed from manual-feed tray 71 to the paper supply path.

Paper Supply Path

Next, the paper supply path (the path internal to hybrid paper supply module 5) for transporting toward main transport path 36 recording paper P that has been taken up by automatic-feed cassette mechanism unit 6 or manual-feed mechanism unit 7, having constitutions as described above, will be described.

This paper supply path is made up of first through sixth guide members 81 through 86. First guide member 81 and second guide member 82 are installed between the aforementioned automatic-feed cassette mechanism unit 6 and manual-feed mechanism unit 7 so as to extend vertically and so as to have a prescribed distance therebetween horizontally. More specifically, first guide member 81 is installed at automatic-feed cassette mechanism unit 6, and second guide member 82 is installed at manual-feed mechanism unit 7; regions in the vicinities of the bottom edges of respective guide members 81, 82 being attached to base section 52*c* of module casing 52A, and regions in the vicinities of the top edges of respective guide members 81, 82 being attached to top section 52*d* of module casing 52A. This being the case, primary path 87, extending vertically, is formed between the two guide members 81, 82; the lower end (upstream end) of this primary path 87 being open to the exterior from base section 52*c* of module casing 52A, and the upper end (downstream end) of this primary path 87 being open to the exterior from top section 52*d* of module casing 52A.

Furthermore, respectively installed at the aforementioned first guide member 81 and second guide member 82 are transport rollers 81*a*, 82*a* which are supported so as to permit rotation about horizontal axes (i.e., about horizontal axes extending in the direction of the width of recording paper P contained therewithin), the outside circumferential surfaces of these transport rollers 81*a*, 82*a* coming in contact with each other. Drive force from a motor, not shown, is transmitted to one of these transport rollers 81*a*, 82*a* (directions of rotation being indicated by arrows in FIG. 10), permitting recording paper P as it is transported within primary path 87 to be transported therealong by virtue of the nip formed between these transport rollers 81*a*, 82*a*. Moreover, provided at the respective top and bottom ends of the aforementioned first guide member 81 and second guide member 82 there are engagement ridges 81*c*, 82*c*, 81*d*, 82*d* for mutual positioning when like hybrid paper supply modules 5 are stacked together such that one is atop the other.

Third guide member 83 is formed so as to be continuous with separator plate 67*b* of the aforementioned automatic-feed cassette mechanism unit 6 and is made up of a plate which is curved so as to be directed upward toward the aforementioned primary path 87. Furthermore, fourth guide member 84, installed at a location causing it to be a prescribed distance from the top surface of the aforementioned third guide member 83, is made up of a plate which is curved so as to be directed upward toward primary path 87. In addition, the ends of this third guide member 83 and this fourth guide member 84 are connected to the periphery of opening 81*b* formed in first guide member 81. As a result, automatic-feed path 88, for transporting to primary path 87 recording paper P that has been taken up from automatic-feed cassette mechanism unit 6, is formed between third guide member 83 and fourth guide member 84.

Fifth guide member 85 is formed so as to be continuous with separator plate 77*b* of the aforementioned manual-feed mechanism unit 7 and is made up of a plate which is curved so as to be directed upward toward the aforementioned primary path 87. Furthermore, sixth guide member 86, installed at a location causing it to be a prescribed distance from the top surface of the aforementioned fifth guide member 85, is made up of a plate which is curved so as to be directed upward toward primary path 87. In addition, the ends of this fifth guide member 85 and this sixth guide member 86 are connected to the periphery of opening 82*b* formed in second guide member 82. As a result, manual-feed path 89, for transporting to primary path 87 recording paper P that has been taken up from manual-feed mechanism unit 7, is formed between fifth guide member 85 and sixth guide member 86.

Because the paper supply path is formed as described above, recording paper P, whether taken up from automatic-feed cassette mechanism unit 6 or manual-feed mechanism unit 7, after passing through the aforementioned primary path 87 provided at the interior of hybrid paper supply module 5 is introduced into main transport path 36 and arrives at printing unit 3, where prescribed image forming operation take place. Accordingly, there is only one path (main transport path 36) by which recording paper P is discharged in going toward printing unit 3 from the discharge side of hybrid paper supply module 5, eliminating the need to have two paths at the hybrid device 1 main body such as would be the case were there one path for the automatic-feed cassette and another path for the manual-feed tray. This being the case, not only is it possible to shorten the length of the overall transport path of hybrid device 1 and achieve simplification of the constitution at the interior of hybrid device 1, but it is also possible to reduce the number of locations at which paper jams can occur, and it is possible to reduce the frequency of occurrence of paper jams.

As shown in FIG. 8, in the present embodiment, a plurality of hybrid paper supply modules 5, 5, . . . are arranged so as to be stacked together below hybrid device 1. Thus, when respective hybrid paper supply modules 5, 5, . . . are stacked together, primary paths 87 provided at respective hybrid paper supply modules 5, 5, . . . communicate in vertically collinear fashion.

Accordingly, when recording paper P is taken up from the uppermost (i.e., that which is located furthest downstream in the recording paper P transport direction) hybrid paper supply module 51, recording paper P taken up from automatic-feed cassette mechanism unit 6 or manual-feed mechanism unit 7 of this hybrid paper supply module 51 is transported to main transport path 36 by way of primary path 87 at the interior of this hybrid paper supply module 51 (see arrows drawn with solid lines at FIGS. 10 through 13).

On the other hand, when recording paper P is taken up from the hybrid paper supply module 52 that is second from the top (i.e., that is second as counted from an extreme downstream location in the recording paper P transport direction), recording paper P taken up from automatic-feed cassette mechanism unit 6 or manual-feed mechanism unit 7 of this hybrid paper supply module 52 is transported to main transport path 36 by way of primary path 87 at the interior of this hybrid paper supply module 52 and primary path 87 at the interior of hybrid paper supply module 51 (arrows drawn with dashed lines at FIGS. 10 through 13 indicate paper transport direction at the interior of this hybrid paper supply module 51).

In like fashion, when recording paper P is taken up from the hybrid paper supply module 53 that is third from the top (i.e., that is third as counted from an extreme downstream location in the recording paper P transport direction), recording paper P taken up therefrom is transported to main transport path 36 after passing in sequence through primary path 87 at the interior of this hybrid paper supply module 53 and primary paths 87 at the interiors of hybrid paper supply modules 52, 51.

Thus, by passing through primary path(s) 87 at interior(s) of hybrid paper supply module(s) located downstream therefrom in the transport direction, recording paper P can be smoothly transported to main transport path 36 regardless of from which among hybrid paper supply modules 51 through 54 it is that recording paper P is taken up.

Moreover, as has been described above, paper trail edge guide member 64 and paper side edge guide members 65, 65 provided at automatic-feed cassette mechanism unit 6 of each hybrid paper supply module 5 are attached (fixed) to the base of automatic-feed cassette 61. This being the case, automatic-feed cassette mechanism units 6 of respective hybrid paper supply modules 5 are each capable of containing a single, fixed size of recording paper P. That is, each automatic-feed cassette mechanism unit 6 is set so as to exclusively accept one specific size of recording paper P. For example, at FIG. 8, topmost-stacked hybrid paper supply module 51 might contain B5-size paper, second-highest hybrid paper supply module 52 might contain A4-size paper, third-highest hybrid paper supply module 53 might contain B4-size paper, and bottom most-stacked hybrid paper supply module 54 might contain A3-size paper. But of course the present invention is not limited hereto.

Furthermore, as has been described above, guide members 79, 79 provided at manual-feed mechanism unit 7 of each hybrid paper supply module 5 are supported so as to permit movement in sliding fashion in or on manual-feed tray 71. This being the case, manual-feed mechanism units 7 of respective hybrid paper supply modules 5 are each not limited to accepting placement therein or thereon of a single size of recording paper P, but are each capable of accepting placement therein or thereon of a variety of sizes of recording paper P. Accordingly, in carrying out paper feed operations, a user may, without regard to paper size, use any arbitrary manual-feed mechanism unit 7. For example, in the event that topmost-stacked hybrid paper supply module 51 lends itself to convenient usage, manual-feed mechanism unit 7 of this hybrid paper supply module 51 may be used regardless of the size of recording paper P. Or in the event that recording paper P of a different size has already been placed in or on this topmost-stacked hybrid paper supply module 51, it is possible to use another hybrid paper supply module. That is, there is no need to perform the task of removing recording paper P from where it has already been placed, it being possible to carry out paper feed operations using another hybrid paper supply module. Or where there are zero or a small number of sheets remaining in an automatic-feed cassette 61 which is intended to contain recording paper P of a particular size (e.g., A4 size in a situation where various sizes of paper are contained in respective hybrid paper supply modules 5 as described above, and the number of sheets of A4-size paper remaining at second-highest hybrid paper supply module 52 is zero), any arbitrary manual-feed mechanism unit 7 might be used to carry out image formation on the required number of sheets of paper of that size. That is, it is possible to quickly cause image forming operations to be completed on the required number of sheets of recording paper P, without the need to perform the task of replenishing paper at automatic-feed cassette 61 (i.e., the task of pulling out automatic-feed cassette 61, loading paper, and pushing automatic-feed cassette 61 thereinto).

Furthermore, of the respective hybrid paper supply modules 51 through 54 in the present embodiment, the length (i.e., dimension in the vertical direction when stored) of manual-feed tray 71 of topmost-stacked hybrid paper supply module 51 is set so as to be greater than the length(s) of the other manual-feed trays 71. The length(s) (i.e., dimension(s) in vertical direction when stored) of manual-feed trays 71 of the other hybrid paper supply modules 52 through 54 are approximately equal to the height(s) of module casing(s) 52A, and these manual-feed trays 71 constitute side surface(s) of module casing(s) 52A when stored. However, manual-feed tray 71 of topmost-stacked hybrid paper supply module 51 is such that this manual-feed tray 71, when in its stored state, constitutes the side surface of module casing 52A; but in addition thereto, the top edge portion of manual-feed tray 71 extends further upward than the top edge of module casing 52A so as to be contained within recess 11 formed at the side surface of the hybrid device casing.

Paper Feed Operations

Paper feed operations carried out by hybrid paper supply module 5 having the foregoing constitution are more or less similar to paper feed operations carried out by the foregoing first embodiment. For this reason, the present second embodiment will be described following the flowchart of FIG. 6 which was used at the first embodiment.

First, if at STEP1 the user operates a control panel of hybrid device 1 (or operates a host device connected thereto) or there is otherwise a request to carry out printing, then at STEP2 determination is made as to whether manual-feed trays 71 of all manual-feed mechanism units 7 are in stored states; i.e., whether each manual-feed mechanism unit 7 is closed off by the side wall of hybrid paper supply module 5. If any manual-feed tray(s) 71 is/are not in stored state(s), i.e., if manual-feed tray(s) 71 is/are in opened state(s), then processing proceeds to STEP3, at which notice is given at a display unit (display panel) of the apparatus that manual-feed tray(s) 71 should be put into stored state(s) (i.e., that manual-feed mechanism unit(s) 7 should be closed). Furthermore, if at STEP4 it is detected that manual-feed tray(s) 71 has or have been stored (manual-feed mechanism unit(s) 7 has or have been closed), then processing proceeds to STEP5.

The user enters print conditions (STEP5); and upon selection of printing paper (i.e., the type of recording paper P to be used for image formation), the value at STEP6 goes to YES, and processing proceeds to STEP7. Here, determination is carried out as to whether the selected print conditions are such that the paper supply source is manual-feed mechanism unit 7. If this is determined to be YES, then processing proceeds to STEP8, at which the aforementioned electromagnet 52*b* is turned OFF, opening manual-feed tray 71 of a specific manual-feed mechanism unit 7 (i.e., manual-feed tray 71 swings down from the side of hybrid paper supply module 5: arrow α in FIG. 11). Furthermore, after, where necessary, carrying out a procedure (arrow β in FIG. 12) in which second tray 75 serving as auxiliary tray is made to pivot (i.e., is opened) and optionally carrying out a procedure (arrow γ in FIG. 13) in which third tray 75A is pulled out therefrom (STEP9), recording paper P is placed on manual-feed tray 71 (STEP10), and processing proceeds to STEP14.

Conversely, if the answer as determined at STEP7 is NO, then it is determined (STEP11) that the paper supply source pursuant to the selected print conditions is automatic-feed cassette mechanism unit 6; and at STEP12, determination is carried out as to whether there is/are automatic-feed cassette(s) 61 of automatic-feed cassette mechanism unit(s) 6 that contain recording paper P of the required size (recording paper P consistent with the foregoing print conditions). If the result of this determination is YES, then processing proceeds to STEP14; but if the result of this determination is NO, then at STEP13 the user carries out operations for loading of recording paper P consistent with print conditions, following which processing proceeds to STEP 14. As examples of this determination as to whether recording paper P consistent with print conditions is loaded therein, paper sensor(s) might be provided at automatic-feed cassette 61, and type(s) (size(s) and/or orientation(s)) of loaded recording paper P might be detected by such sensor(s) and displayed at display panel(s), with determination being carried out pursuant to confirmation of such display by the user; or a warning might be issued to the user in the event that type(s) of recording paper P loaded in automatic-feed cassette 61 as confirmed by hybrid device 1 is/are different from type(s) of recording paper P at the foregoing print conditions, prompting the user to carry out operations for loading of recording paper P consistent with print conditions; and so forth.

Moreover, printing processing is carried out at STEP14; and after paper has been supplied from the desired mechanism unit and image forming has at printing unit 3 been carried out on that recording paper P, operations are carried out for discharge thereof to discharge tray 35.

After printing operations have been carried out on this single sheet of recording paper P, determination is made at STEP15 as to whether there is subsequent printing to be carried out (i.e., whether subsequent print information exists); the operations at STEPS 14 and 15 being carried out in repeated fashion until subsequent print information does not exist. Moreover, when subsequent print information no longer exists, determination is carried out at STEP16 as to whether subsequent print job(s) exist; and in the event that there is/are subsequent print job(s), processing returns to STEP2; the foregoing operations being carried out in repeated fashion until subsequent print job(s) no longer exist.

Benefits of Second Embodiment

As has been described above, in the present embodiment, because manual-feed tray(s) 71 is/are constructed so as to permit extension and/or retraction in three stages, while total length(s) of manual-feed tray(s) may be decreased when manual-feed tray(s) 71 is/are in stored state(s), it is nonetheless possible during usage thereof (i.e., when manual-feed tray(s) 71 is/are deployed at time(s) when recording paper P is to be placed therein or thereon) to increase total length(s) of manual-feed tray(s) to extent(s) sufficient to prevent such recording paper P from falling therefrom. Because manual-feed mechanism units 7 of all of the hybrid paper supply modules 5 are provided with such capability, user(s) can, regardless of which size(s) of recording paper P is/are to be used, utilize any arbitrary hybrid paper supply module(s) 5 to carry out manual paper feed.

Furthermore, because automatic-feed cassette mechanism unit(s) 6 and manual-feed mechanism unit(s) 7 may be incorporated into a single integral hybrid paper supply module 5, it is possible for manual-feed mechanism unit(s) 7 to be arranged so as to be stacked vertically with respect to flipping transport path(s) 37 and main transport path(s) 36 extending so as to be directed toward printing unit(s) 3 of hybrid device(s) 1, as a result of which it is possible to shorten dimension(s) of hybrid device(s) 1 and achieve reduction in the amount of space required for installation.

Furthermore, this hybrid paper supply module 5 makes it possible to cause the path along which recording paper P taken up from automatic-feed cassette mechanism unit 6 is transported and the path along which recording paper P taken up from manual-feed mechanism unit 7 is transported to intersect at the interior of module 5, and makes it possible to decrease the lengths of the respective paths. This being the case, the length of the overall paper transport path of the apparatus can be shortened, the number of locations at which paper jams can occur can be reduced, and image forming operations at the apparatus can be carried out in stable fashion.

Other Embodiments

Whereas in the foregoing embodiments the present invention has been described in terms of an example in which it is applied to a multifunction image forming apparatus (hybrid device) 1 combining the functions of copier, printer, and facsimile machine, the present invention is not limited thereto but may also be applied to an image forming apparatus provided with any one function, and to other image forming apparatuses as well.

Furthermore, whereas manual-feed tray 71 of manual-feed mechanism unit 7 permitted adjustment of length in three stages; the present invention is not limited thereto, it being possible to adopt a constitution in which length is adjustable in two stages or in which length is adjustable in four or more stages. Selection of the number(s) of stages to be employed at such manual-feed tray(s) 71 will depend upon height(s) of hybrid paper supply module(s) 5 and size(s) of recording paper P likely to be used thereat. For example, if the height of hybrid paper supply module 5 is on the order of 150 mm and the size of recording paper P likely to be used thereat is not larger than A4, then adjustment in two stages (i.e., provision of only the foregoing first tray 74 and second tray 75) should be sufficient. The reason for this is that it will be possible to achieve lengths respectively on the order of 130 to 145 mm for each the first tray 74 and the second tray 75 without requiring that either extend beyond the top edge of hybrid paper supply module 5. Furthermore, where the height of hybrid paper supply module 5 is on the order of 150 mm but the size of recording paper P likely to be used thereat is A3, adjustment in three stages (i.e., provision of the foregoing first, second, and third trays 74 through 75A) will be necessary. Moreover, where the size of recording paper P likely to be used thereat is not larger than A4 but the height of hybrid paper supply module 5 is on the order of 80 mm, adjustment in three stages (i.e., provision of the foregoing first, second, and third trays 74 through 75A) will be necessary.

Moreover, the present invention may be embodied in a wide variety of forms other than those presented herein without departing from the spirit or essential characteristics thereof. The foregoing embodiments and working examples, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are, moreover, within the scope of the present invention.

What is claimed is:

1. A hybrid paper supply module comprising:

at least one automatic-feed cassette mechanism unit capable of containing one or more recording media for image formation to be carried out at one or more image forming units of one or more image forming apparatuses;

at least one manual-feed mechanism unit permitting placement therein or thereon of one or more recording media;

at least one first path for transporting one or more recording media taken up from said at least one automatic-feed cassette mechanism unit;

at least one second path transporting one or more recording media taken up from said at least one manual-feed mechanism unit; and at least one common path at which said at least one first path and said at least one second path are made to mutually intersect with each other and thereafter extend toward said at least one of the image forming unit or units;

wherein, of the respective paths, said at least one common path is capable of being opened up to the exterior when said at least one manual-feed mechanism unit is manipulated by said opening grip region;

wherein said at least one automatic-feed cassette mechanism unit and said at least one manual-feed mechanism unit are configured as a single module;

wherein said at least one manual-feed mechanism unit is equipped with at least one manual-feed tray which is capable of being stored at least one side of the hybrid paper supply module when not in use, said at least one manual-feed mechanism unit installed such that it can be moved so as to permit user access to at least one recording medium transport path within the hybrid paper supply module, when said hybrid paper supply module is opened up to the exterior; and wherein said at least one manual-feed tray includes at least one deployment grip region, said deployment grip region being located on an outside surface of the image forming apparatus when the manual-feed tray is in a stored state, and said deployment grip region being capable of causing said at least one manual-feed tray to assume at least one deployed state permitting placement therein or thereon of one or more recording media; and wherein said at least one manual-feed tray further includes at least one opening grip region, said at least one opening grip region being capable of causing said manual-feed mechanism unit to be pulled out, opening up the interior of the hybrid paper supply module to the exterior thereby permitting user access to said at least one recording medium transport path.

2. The hybrid paper supply module according to claim 1 wherein:

said at least one automatic-feed cassette mechanism unit and said at least one manual-feed mechanism unit are both contained within at least one casing of the hybrid paper supply module;

said at least one automatic-feed cassette mechanism unit is configured so as to be capable of being pulled out from said at least one casing when directed toward at least a front portion of said at least one of the image forming apparatus or apparatuses; and said at least one manual-feed mechanism unit is configured so as to be capable of being pulled out from said at least one casing when directed toward at least one side portion of said at least one of the image forming apparatus or apparatuses, wherein said at least one opening grip region is used to pull out said at least one manual-feed mechanism unit.

3. The hybrid paper supply module according to claims 1 or 2 wherein:

said at least one common path is formed by one or more spaces between at least one first guide member provided at least one of the automatic-feed cassette mechanism unit and at least one second guide member provided at least one of the manual-feed mechanism unit; and in accompaniment to movement of said at least one manual-feed mechanism unit, said at least one second guide member moves away from said at least one first guide member, causing said at least one common path to be opened up to the exterior.

4. An image forming apparatus equipped with at least one hybrid paper supply module according to claim 1 or 2, wherein image formation is carried out on one or more recording media supplied to said at least one of the image forming unit or units from either said at least one automatic-feed cassette mechanism unit or said at least one manual-feed mechanism unit.

5. The hybrid paper supply module according to claim 1 wherein said at least one recording medium transport path is a common path to said at least one automatic-feed cassette mechanism unit and said at least one manual-feed mechanism unit, said common path being capable of transporting one or more recording media from either of said at least one automatic-feed cassette mechanism unit or said at least one manual-feed mechanism.

6. The hybrid paper supply module according to claims 1 or 2 wherein:

said user access to at least one recording medium transport path comprises access such that at least one user of said one or more image forming apparatuses can manipulate with his or her hand paper that is jammed in said at least one common path.

7. A paper supply mechanism comprising a plurality of hybrid paper supply modules that are stacked together:

each of said plurality of hybrid paper supply modules having:

at least one automatic-feed cassette mechanism unit capable of containing one or more recording media for image formation to be carried out at one or more image forming units of one or more image forming apparatuses; and at least one manual-feed mechanism unit permitting placement therein or thereon of one or more recording media;

wherein said at least one automatic-feed cassette mechanism unit and said at least one manual-feed mechanism unit are included in a single module;

wherein said at least one manual-feed mechanism unit of each of the hybrid paper supply modules is respectively equipped with at least one manual-feed tray that permits placement therein or thereon of one or more recording media; and wherein each of said plurality of manual-feed trays are collapsible so as to decrease at least one total length thereof and permit storage thereof at least one side of at least one of the hybrid paper supply modules when not in use, wherein each of said plurality of the manual-feed trays is constituted such that upon being deployed after being stored at least one side of at least one of the hybrid paper supply module, placement therein or thereon of one or more recording media by at least one user is made possible and access is opened up to at least one recording medium transport path at least one of the manual-feed mechanism unit.

8. The paper supply mechanism according to claim 7, wherein at least one operation for causing said at least one manual-feed tray to be deployed from at least one state in which it had been stored at least one side of said at least one hybrid paper supply module occurs by means of at least one manual manipulation or at least one automatic operation performed by at least one automatic deployment mechanism.

* * * * *